US006983632B2

(12) United States Patent
Mayfield

(10) Patent No.: US 6,983,632 B2
(45) Date of Patent: Jan. 10, 2006

(54) METHOD AND APPARATUS FOR SPINNING TO A CONSTANT LENGTH

(75) Inventor: David Mayfield, South Bend, IN (US)

(73) Assignee: Hess Engineering, Inc., Niles, MI (US)

( * ) Notice: Subject to any disclaimer, the term of this patent is extended or adjusted under 35 U.S.C. 154(b) by 0 days.

(21) Appl. No.: 10/300,347

(22) Filed: Nov. 20, 2002

(65) Prior Publication Data

US 2004/0093922 A1 May 20, 2004

(51) Int. Cl.
*B21D 22/00* (2006.01)

(52) U.S. Cl. ..... 72/84; 72/82; 72/370.01; 72/370.1

(58) Field of Classification Search ..... 72/82, 72/83, 84, 85, 370.01, 370.02, 370.1, 105, 72/115, 121, 125
See application file for complete search history.

(56) References Cited

U.S. PATENT DOCUMENTS

| | | | | |
|---|---|---|---|---|
| 4,313,323 | A * | 2/1982 | Kanemitsu | 72/84 |
| 5,640,867 | A | 6/1997 | Massee | |
| 5,653,138 | A * | 8/1997 | Kruger et al. | 72/84 |
| 5,687,599 | A * | 11/1997 | Donaldson et al. | 72/62 |
| 5,758,532 | A | 6/1998 | Massee | |
| 5,775,151 | A | 7/1998 | Massee | |
| 5,806,358 | A * | 9/1998 | Rolf | 72/68 |
| 5,901,595 | A | 5/1999 | Massee | |
| 5,906,127 | A * | 5/1999 | Nakamura | 72/85 |
| 5,937,516 | A | 8/1999 | De Sousa et al. | |
| 5,960,661 | A | 10/1999 | Massee | |
| 6,195,595 | B1 | 2/2001 | Massee | |
| 6,381,843 | B1 * | 5/2002 | Irie et al. | 29/890 |
| 6,505,490 | B2 * | 1/2003 | Hodjat et al. | 72/84 |
| 2003/0019269 | A1 * | 1/2003 | Rolf | 72/85 |

FOREIGN PATENT DOCUMENTS

| | | |
|---|---|---|
| DE | 503592 | 7/1930 |
| JP | 02070327 | 3/1990 |
| JP | 06182471 | 7/1994 |

OTHER PUBLICATIONS

International Search Report in corresponding European Patent Application, dated Mar. 15, 2004, 3 pages.

* cited by examiner

*Primary Examiner*—Ed Tolan
(74) *Attorney, Agent, or Firm*—Baker & Daniels LLP

(57) ABSTRACT

An apparatus and process is disclosed for spinning circumferential articles with constant length end surfaces. The article is first spun to define the circumferential surface, and a mandrel is then introduced, whereby the mandrel has a shoulder positionable adjacent to the end surfaces. The end surfaces, while supported by the mandrel, are further spun, and the material is flow formed into the shoulder, to define a constant and defined length to the article.

20 Claims, 24 Drawing Sheets

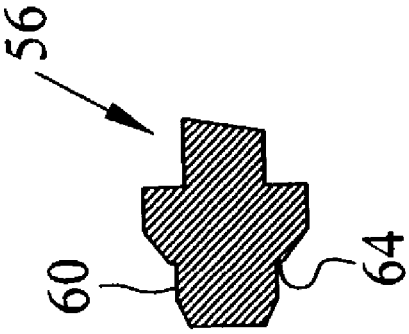
FIG. 4A
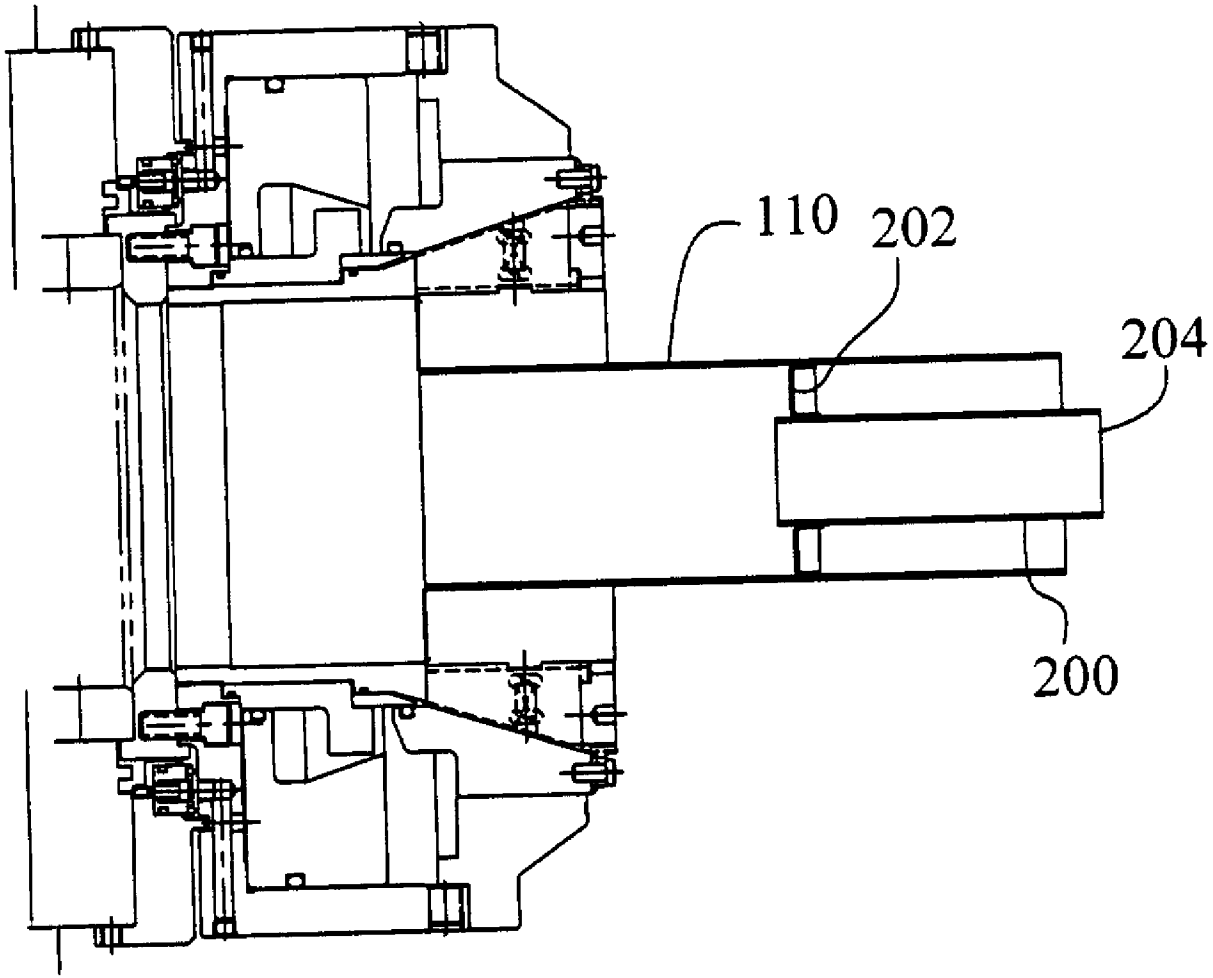

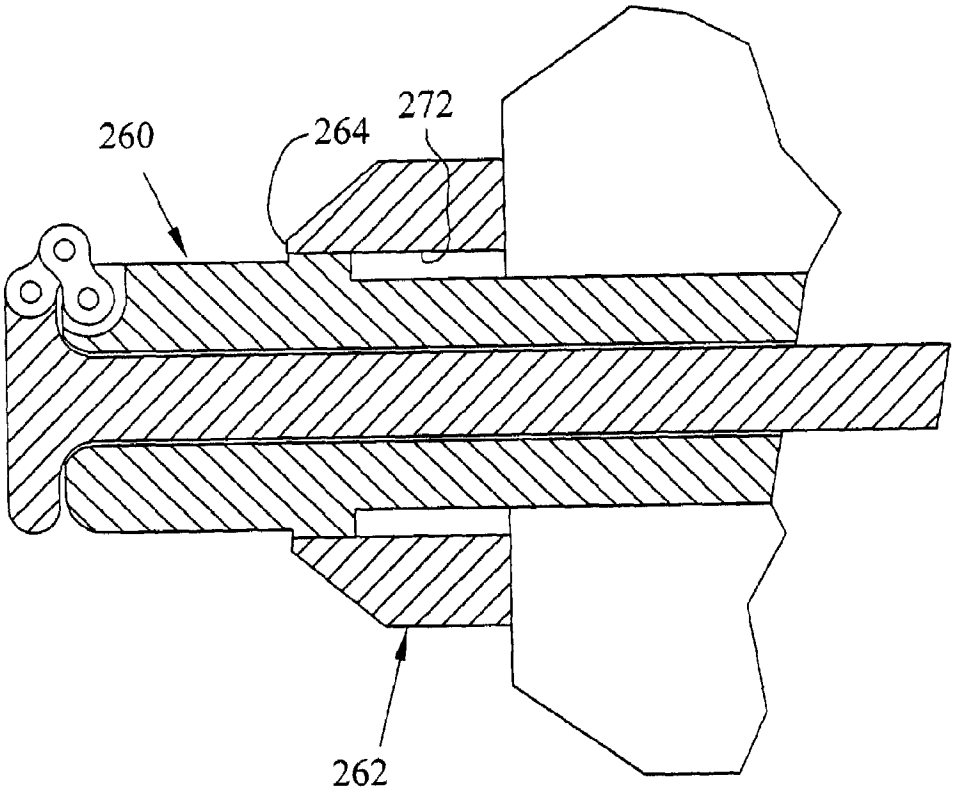
FIG. 6
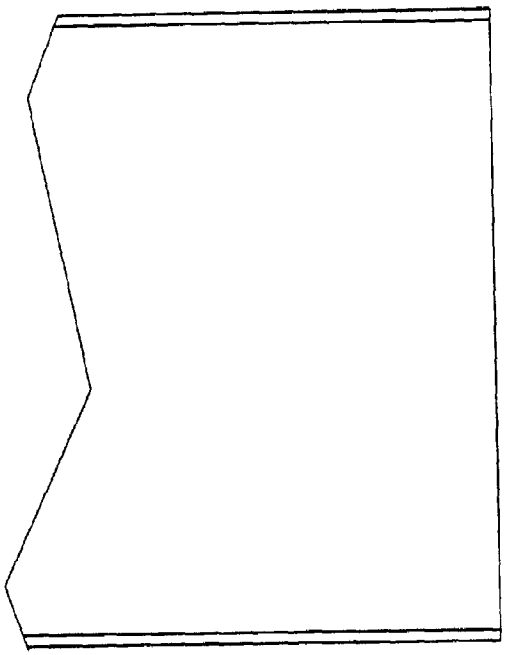

METHOD AND APPARATUS FOR SPINNING TO A CONSTANT LENGTH

BACKGROUND OF THE INVENTION

It is well known in the art of spinning to provide a spinning machine including a plurality of chuck jaws, which confixedly hold material to be spun, such as a tubular member. The tubular member is spun in the chuck and a roller is moved transversely of the longitudinal length of the material, such that the roller engages the tube. The roller is then moved in an axis parallel to the longitudinal axis of the tubular member. In this way, the material of the tubular member can be formed into various configurations, such as a reduced diameter neck portion.

As efficient as the spinning process is, one of the difficulties is controlling the length of the end edges of the tubular member while spinning and the overall length after spun. Any discontinuity in the length of the end edges is exaggerated, such that after spinning, the end edges of the material spun could be rather jagged even including sinuous-shaped contours. This discontinuity of the end edges has heretofore required secondary operations to provide a constant length end. Not only is the discontinuity of the end edges a disadvantage, but the secondary operation more than likely requires removal of the tubular member from the chuck jaws, thereby losing any longitudinal registration with the tooling.

SUMMARY OF THE INVENTION

The objects of the invention have been accomplished by providing a method of spinning a material to a circumferential configuration having a constant length, where the method comprises multiple steps. The material to be spun is first provided and held. The material is next spun about a longitudinal axis. A tooling roller is moved tangentially towards the spinning material, and the roller is then moved along an axis parallel to the longitudinal axis, thereby spinning the material to a radially different configuration. A shoulder is provided with a predefined definition, and the material is flow formed such that free end edges of the material abut the shoulder to conform the end edges to the predefined definition.

In one method the shoulder is provided as a transverse plane, transverse to the longitudinal axis. The shoulder can be provided in the form of a mandrel. The mandrel can be provided in a dimension generally along the longitudinal axis, having a first end portion with a constant first end diameter to extend below the free end edges, and a second diameter, spaced from the first end diameter, and having a diameter larger than the first end diameter forming the shoulder therebetween. The material can be provided tubular in shape. The material can be held by a chuck, where the chuck spins about the longitudinal axis to spin the tubular material. The tooling roller is moved in a direction from the chuck towards the mandrel. The free end edges are spun to a diameter less than the first end diameter, and the first end of the mandrel is forced into the tubular spun end. The flow-forming step is performed by moving the tooling roller along the material, forcing the material against the first end portion of the mandrel, thereby moving the material towards the shoulder.

In another aspect of the invention, an inner member is provided, profiled for receipt within the tubular member, wherein the tubular member is spun to encapsulate the inner member. In this manner a catalytic converter is formed by the further steps of inserting at least one monolith substrate into the tubular member, prior to the spinning process, and spacing the monolith from an end to be spun; positioning a funnel shaped heat shield into the tubular member, with a reduced diameter section directed outwardly, and with an enlarged diameter section adjacent to the substrate; and spinning the tubular end to generally conform to the shape of the funnel shaped heat shield.

The mandrel can be provided with a frusto-conical shaped portion, extending continuously from the second diameter. The second diameter is less than a diameter of the tubular member, and the frusto-conical shaped portion has an end diameter larger than a diameter of the tubular member. The mandrel, prior to the spinning step, is positioned with the frusto-conical shaped portion in abutment with the tubular member, and the tubular member is spun by moving the tooling roller in a direction from the mandrel towards the chuck, thereby collapsing the tubular member against the frusto-conical shaped member. The mandrel is thereafter gradually backed out, and the material is continuously spun to a further reduced diameter portion.

In another aspect of the invention, an apparatus for spinning a material workpiece to a circumferential configuration having a constant length, is comprised of a spinning chuck having jaws to hold a material workpiece to be spun; and a mandrel having a first end having a constant diameter, which terminates into a shoulder, the mandrel being longitudinally movable into an open end of the workpiece.

The mandrel can further comprise a frusto-conical portion extending from the mandrel first end, the frusto-conical portion enlarging away from the mandrel first end, whereby an end of the frusto-conical portion forms the shoulder. The frusto-conical portion is longitudinally movable relative to the mandrel first end. The mandrel first end has a holding mechanism for holding an item to be inserted into the material workpiece. The holding mechanism is comprised of telescopically movable members, connected at their front ends by way of a toggle link, whereby the members have a first position wherein the toggle links form the holding member and have a radial dimension greater than the mandrel first end, and a second position whereby the toggle links have a radial dimension equal to or less than the mandrel first end.

DESCRIPTION OF THE DRAWINGS

FIGS. 4A–4G show yet another embodiment of the apparatus and the associated process steps;

FIGS. 5–7 show an alternate embodiment of a mandrel;

DETAILED DESCRIPTION OF THE INVENTION

With reference first to FIGS. 1A–1F, the length control process will be described diagrammatically. It should be understood that in each of the FIGS. 1A–1F, the dashed line is the longitudinal center line, with only one-half of the tubular member being shown.

Figure 1A:
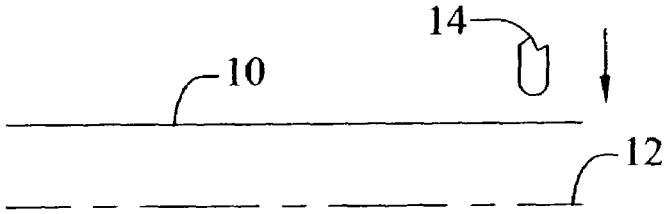
FIGS. 1A–1F show diagrammatically a spinning process including the provision of a mandrel to form the spun end with a constant longitudinal length.
Figure 1B:
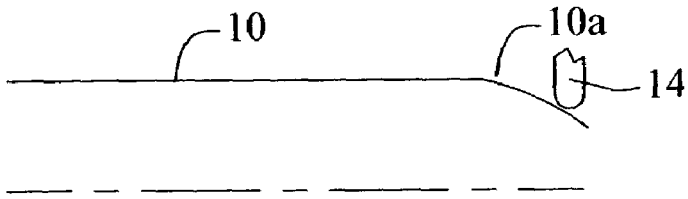
Figure 1C:
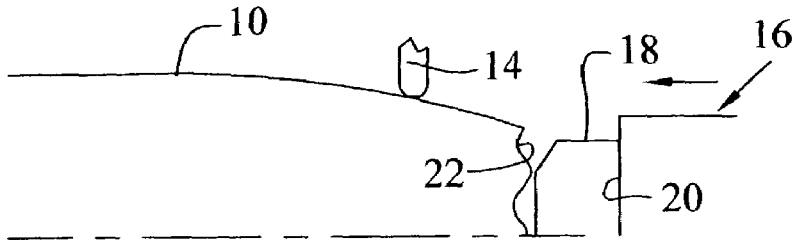

With reference first to FIG. 1A, a tubular member such as 10 is shown, which would be held in a spinning machine, as hereafter described and spun about a longitudinal axis 12. A roller such as 14 is movable transversely of the longitudinal axis 12, as well as along any other longitudinal axis, which is parallel to axis 12. As shown in FIG. 1B, roller 14, as it moves transversely and laterally, moves and forms tubular member 10 to have a radiused portion 10A. As shown in FIG. 1C, a mandrel is shown at 16 having a first end 18 of a constant diameter. A shoulder is formed at 20 as will be described. With respect still to FIG. 1C, as described above, as the tubular member 10 is spun, a jagged or discontinuous end edge is formed, and is shown at 22 in FIG. 1C.

Figure 1D:
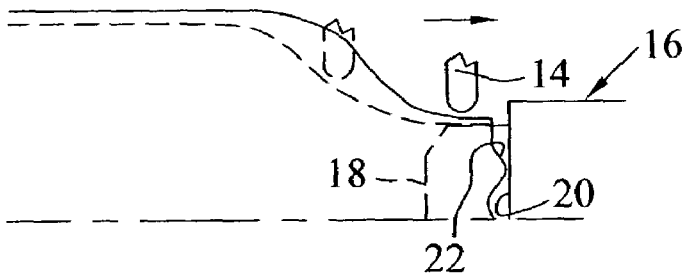
Figure 1E:
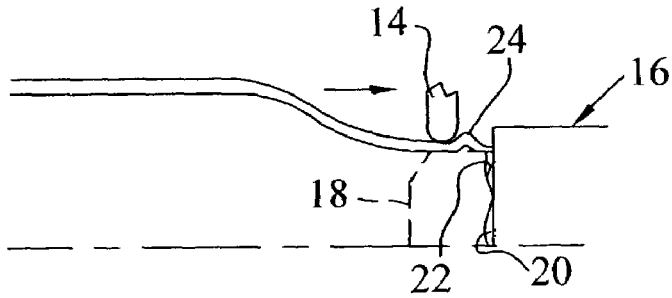
Figure 1F:
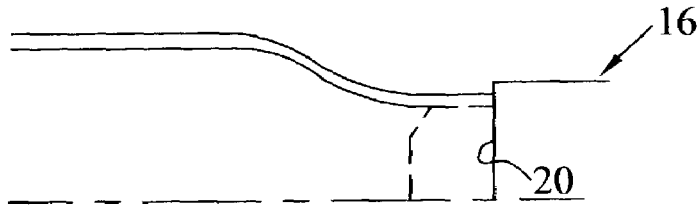

As shown in FIG. 1D, mandrel 16 is shown with first end 18 extending into the tubular member, with shoulder 20 positioned adjacent to jagged edge 22. As shown in phantom in FIG. 1D, the roller continues to process the contour of the tubular member 10 to the desired shape. As shown in FIG. 1E, once the tubular member is near its end configuration, roller 14 may now continue to move from left to right as viewed in FIG. 1E by pressing the material intermediate the roller 14 and the mandrel first end 18. This pressure, and the entrapment between the mandrel 18, causes a flow forming of the material, such that the material bulges or is formed into a wave as shown in FIG. 1E as 24. This causes an elongation of the material, such that the material flow forms until it abuts shoulder 20, as shown in the final position 1F, whereby the material is flow formed into a constant shoulder, thereby providing a constant thickness end and length to the material and tubular member 10.

Advantageously, the mandrel 16 and the mechanism for holding and spinning the material can be provided in the same apparatus, therefore, the longitudinal registration between the two is correlated, such that the longitudinal length of the end device can be fixed in one apparatus.

Figure 2A:
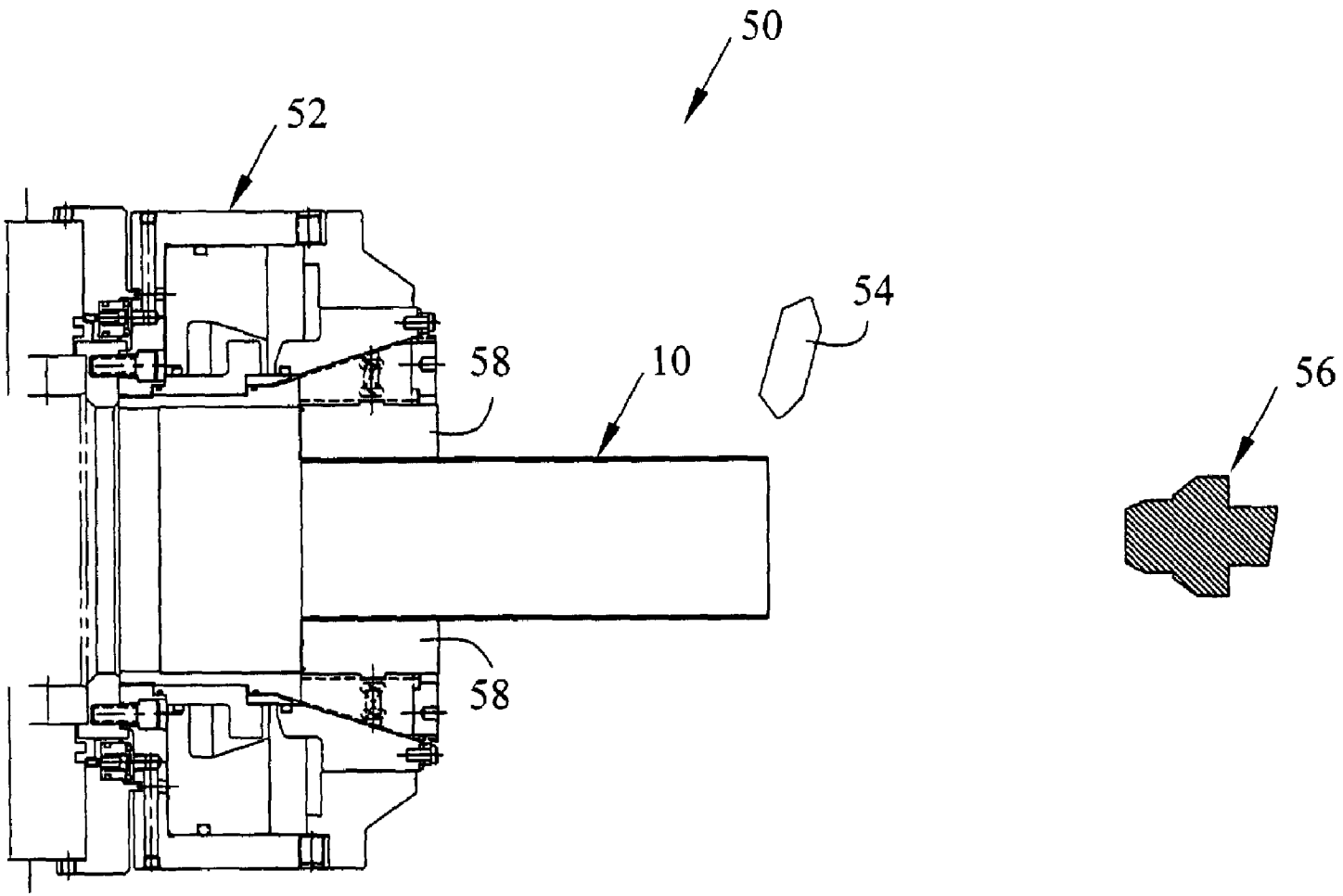
FIGS. 2A–2F show an apparatus and process steps substantially according to the process shown in FIGS. 1A–1F.
Figure 2B:
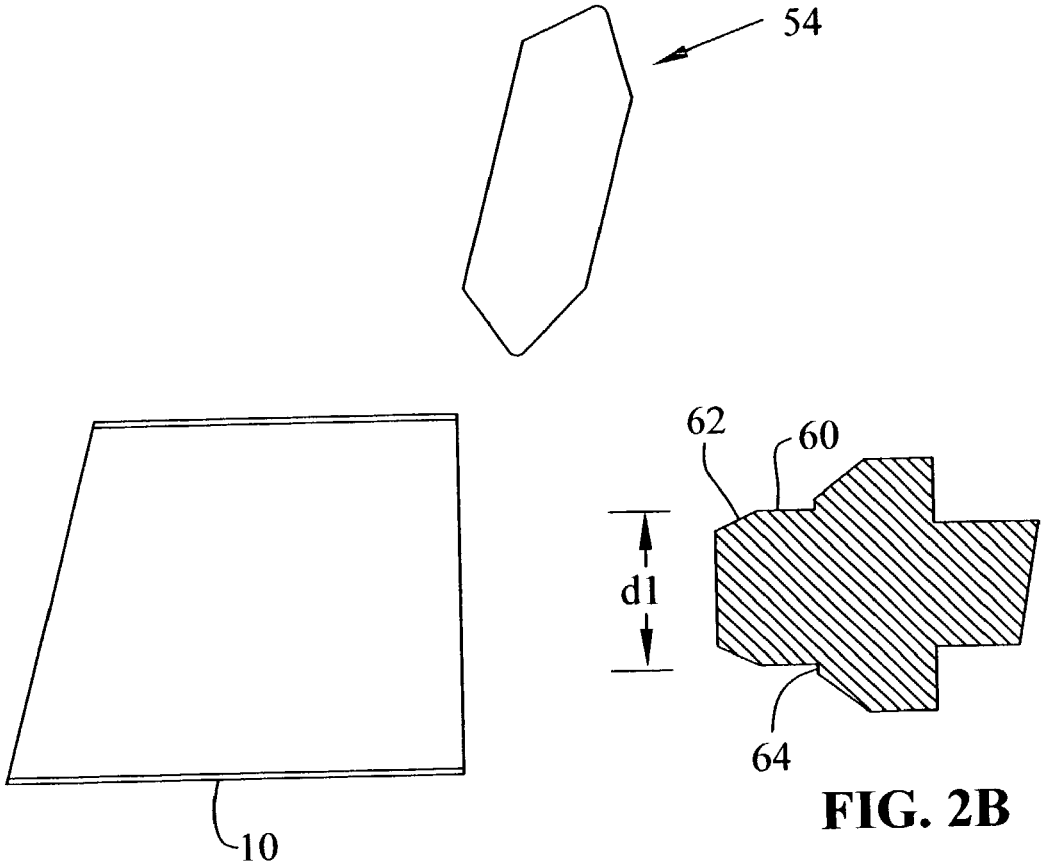

With respect now to FIG. 2A, an apparatus is shown at 50 and is generally comprised of a spinning chuck at 52, a roller mechanism 54, and a mandrel portion at 56. It should be understood that the mandrel 56 forms the length-controlled tooling, which is attached to the primary axis tail stock of the spinning machine. As shown in FIG. 2A, the spinning chuck 52 is generally comprised of a plurality of chuck jaws, such as 58, which are movable radially inward and outward so as to retain tubular member 10 therein. As shown in FIG. 2B, mandrel 56 is comprised of a first end portion 60 having a diameter $d_1$ and a lead-in section at 62. The first end portion 60 has a constant diameter which extends rearwardly to a shoulder section at 64.

Figure 2C:
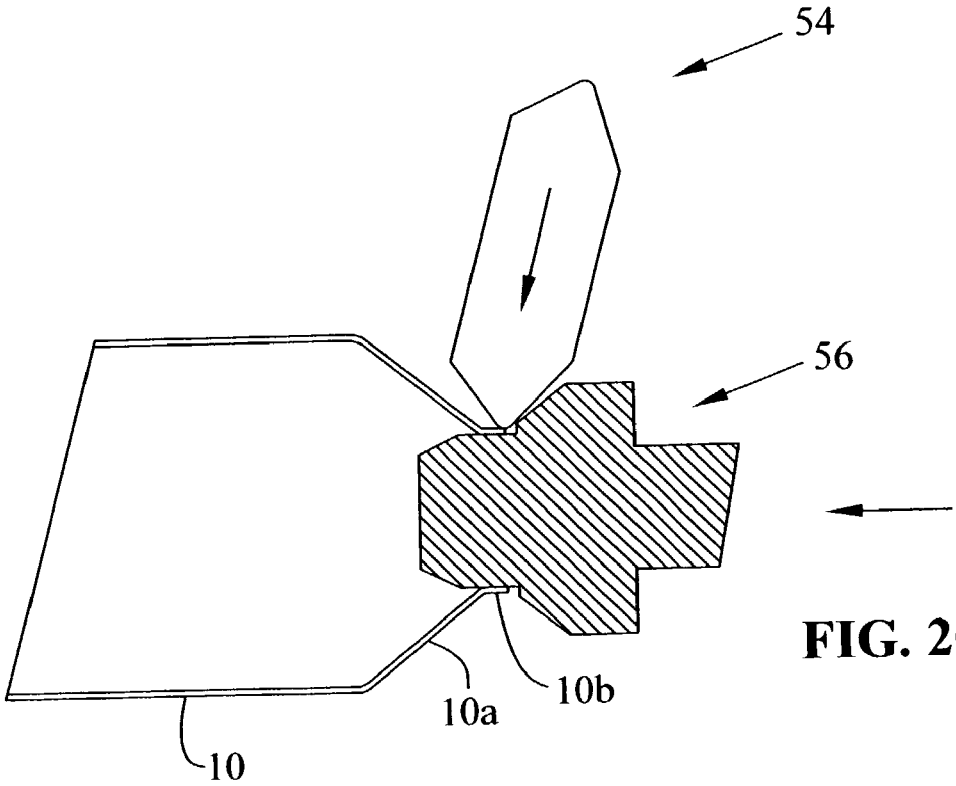
Figure 2D:
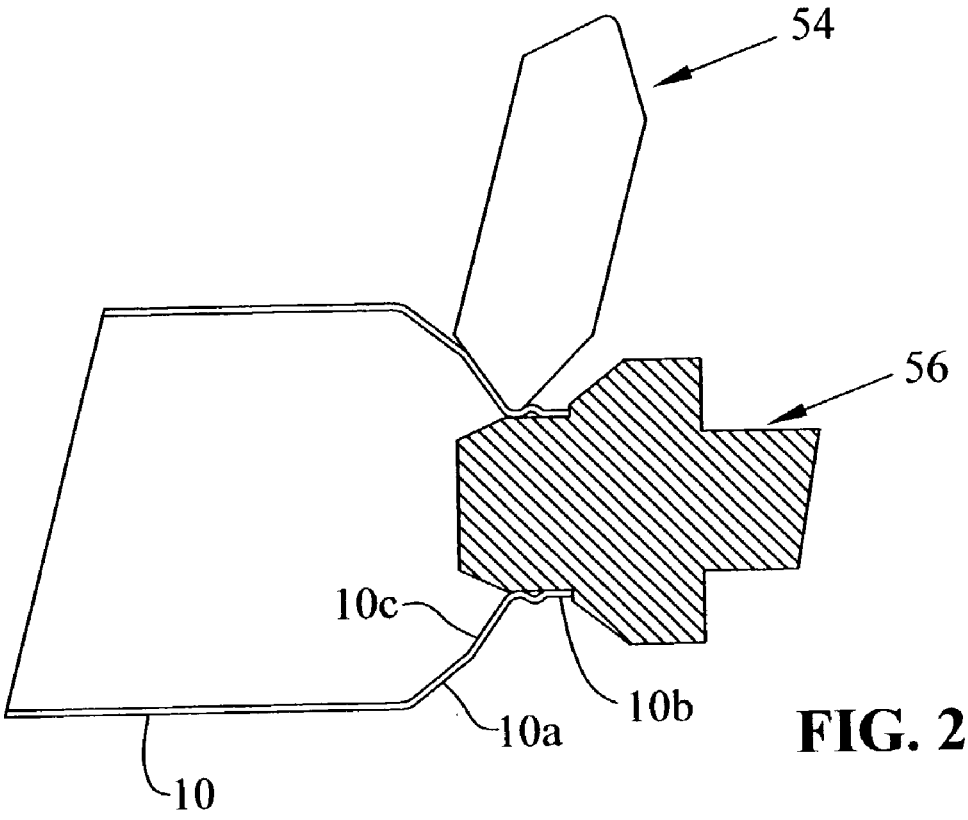
Figure 2E:
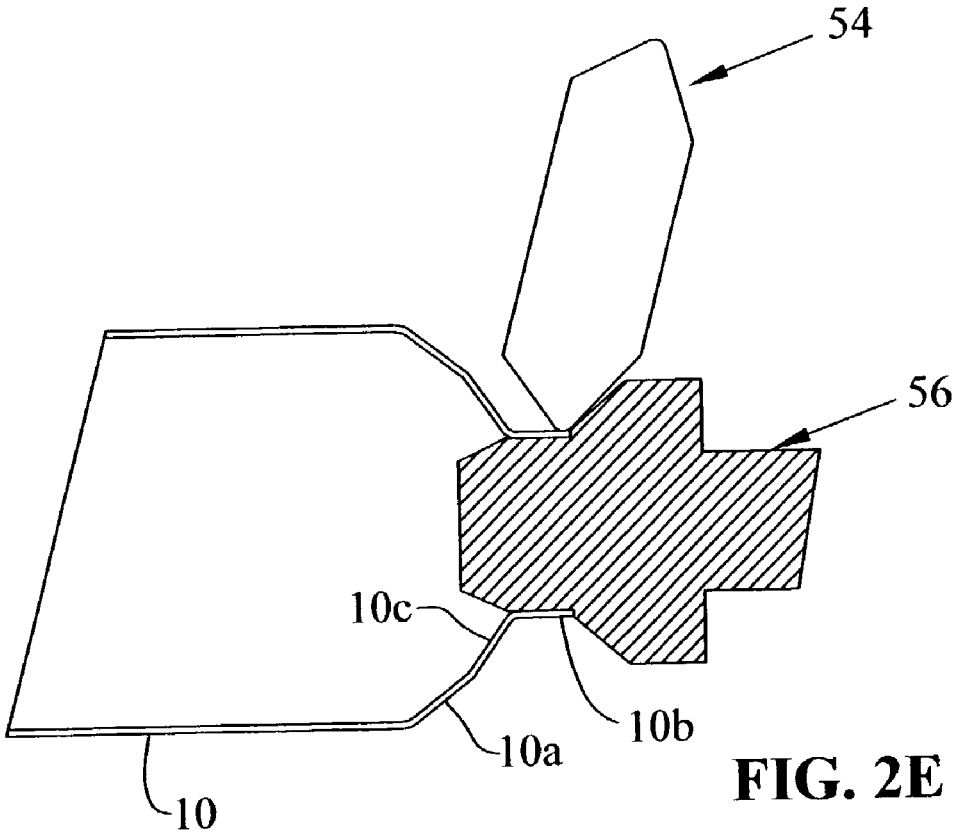
Figure 2F:
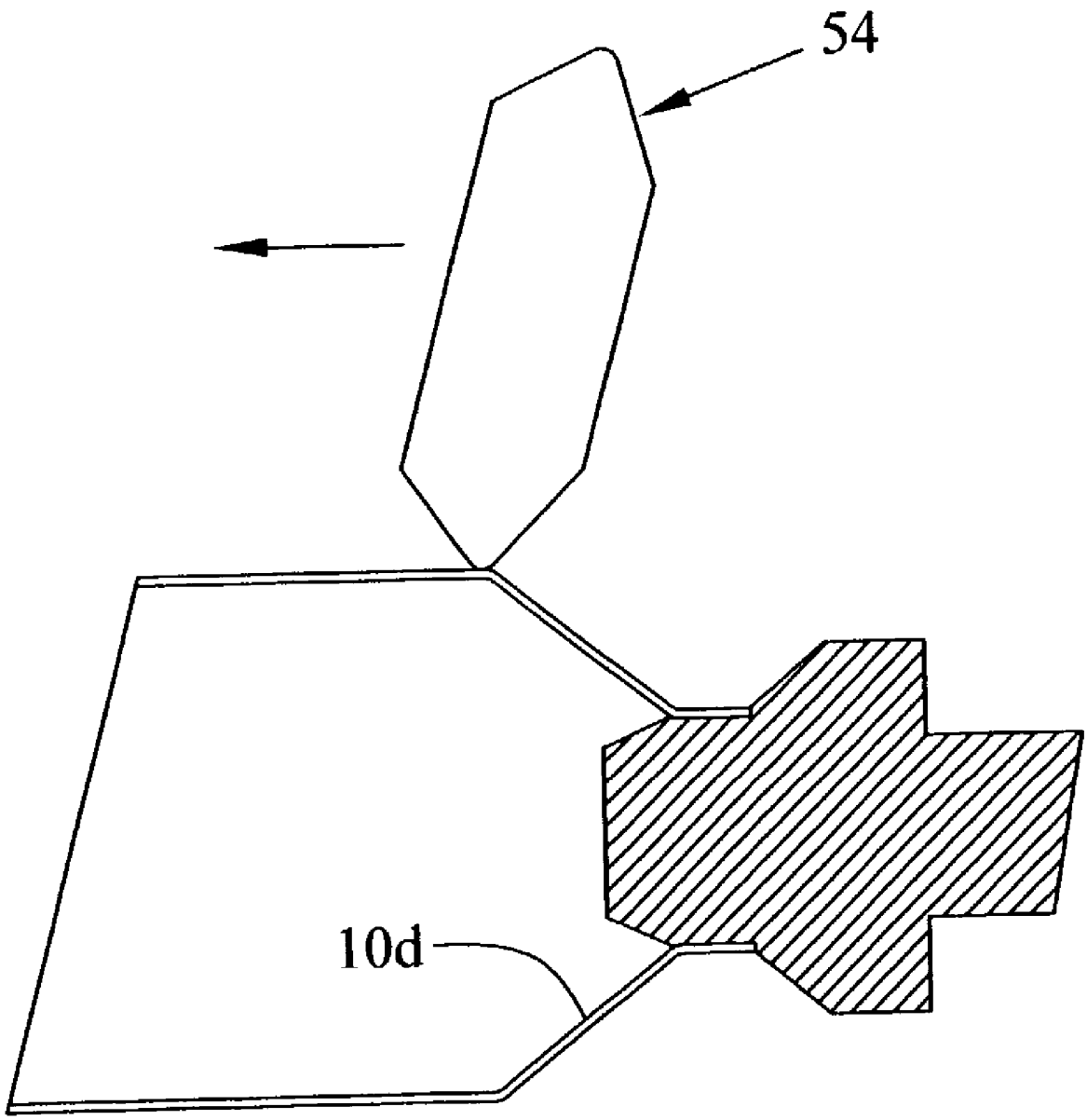

With the apparatus as described in FIGS. 2A and 2B, the process will be described with respect to FIGS. 2C to 2F. As shown first in FIG. 2C, roller 54 is movable in a transverse direction toward tubular member 10, such that a tapered section 10*a* is formed in tubular member 10. Mandrel 56 is now movable toward tubular member 10 to the position shown in FIG. 2C, where the first end 60 of mandrel 56 is positioned within the tapered section 10*a* of tubular member 10. As shown in FIG. 2C, tube end or land 10*b* is substantially parallel with first end 60 of mandrel 56 and is supported by the mandrel first end. As shown in FIG. 2D, the roller 54 is now projected into the tubular member 10, to create a transition section 10*c*, and causing an enlargement or elongation of land area 10*b*. As shown in FIGS. 2D and 2E, as the roller continues to spin land 10*b*, from the position shown in FIG. 2D to the position shown in FIG. 2E, the spinning flow forms the material of land 10*b* into shoulder 64 (FIG. 2B), as best shown in FIG. 2E. If necessary, the roller 56 can be moved in an opposite sense as shown, to smooth out the transition sections 10*a* and 10*c*, as shown in FIG. 2F to form a modified transition section 10*d*. As mentioned above, as chuck 52 and mandrel 56 are incorporated into the same spinning apparatus, the longitudinal registration between chuck 52 and mandrel 56 can be monitored and held in registration, such that the length of tube 10 can be controlled.

Figure 3A:
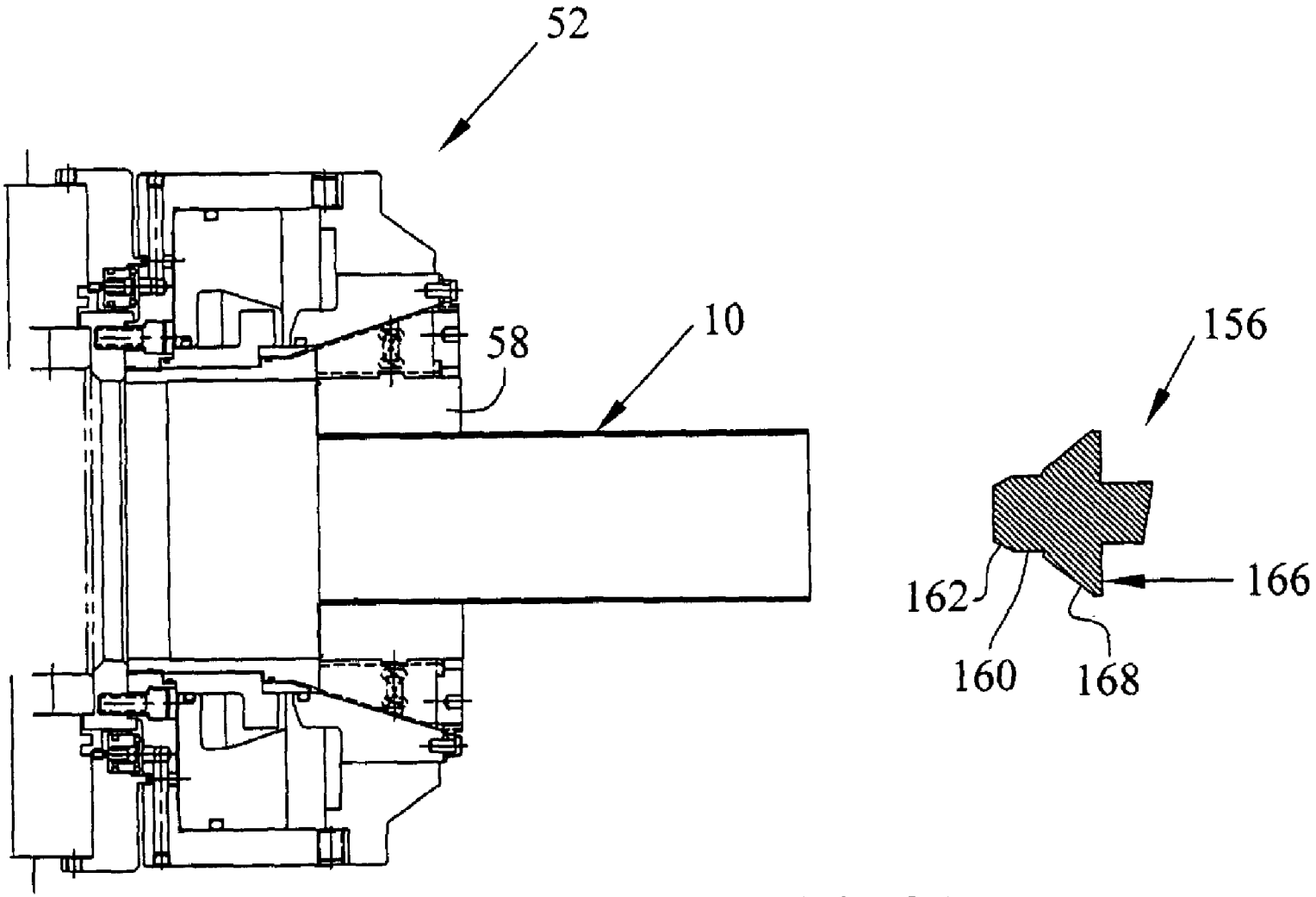
FIGS. 3A–3I show a further embodiment of the apparatus and the associated process steps.
Figure 3B:
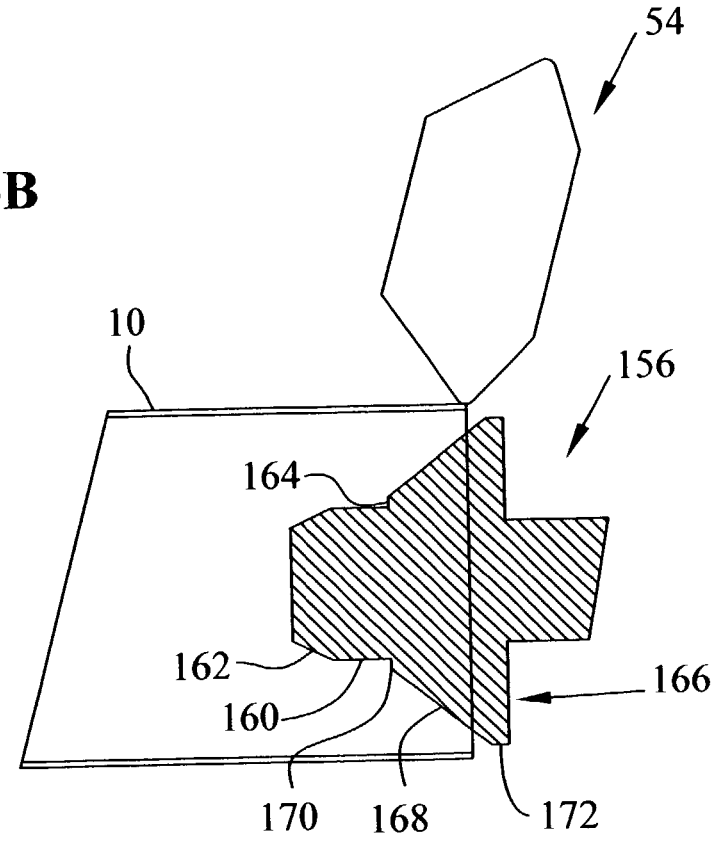
Figure 3C:
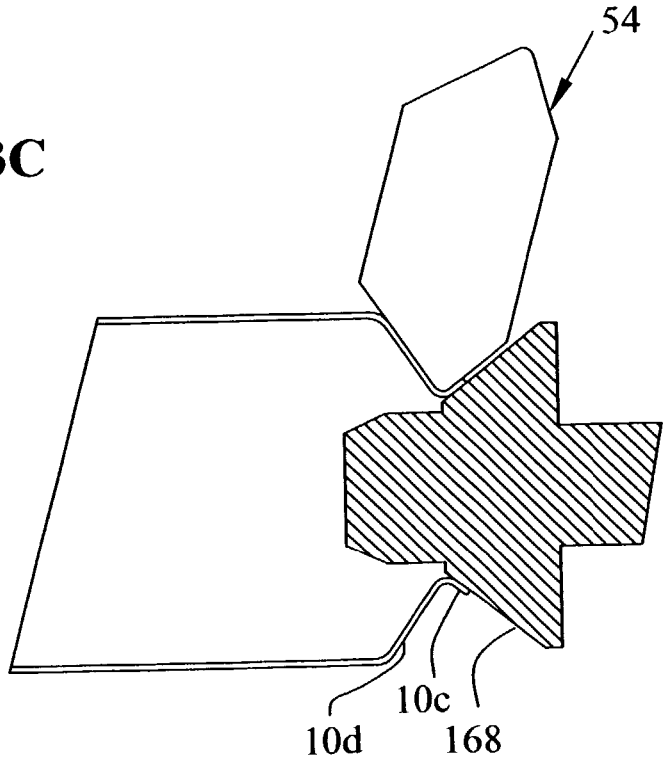

With reference now to FIGS. 3A and 3B, an alternate mandrel is shown at 156 having a first end at 160, with a tapered end portion at 162. A frusto-conical section 166 is positioned rearwardly of first end 160, such that a front end of the frusto-conical portion 166 forms shoulder 164. The frusto-conical portion 166 further comprises a conical surface 168, having a first diameter or radial portion at 170 and a second and enlarged diameter or radial portion at 172. In the embodiment shown in FIG. 3B, the radial portion 172 is slightly smaller than the diameter of tubular member 10. Mandrel 156 is moved towards tubular member 10, such that conical surface 168 is positioned within an end of the tubular member 10. Roller 54 is now moved towards tubular member 10 and is moved in a direction inwardly and towards the chuck 52, as shown in FIG. 3C, such that a portion 10*c* of the tube is pressed against, and conforms to, the conical surface 168. This also forms another reduced diameter section at 10*d* integral with the remainder of tubular member 10.

Figure 3D:
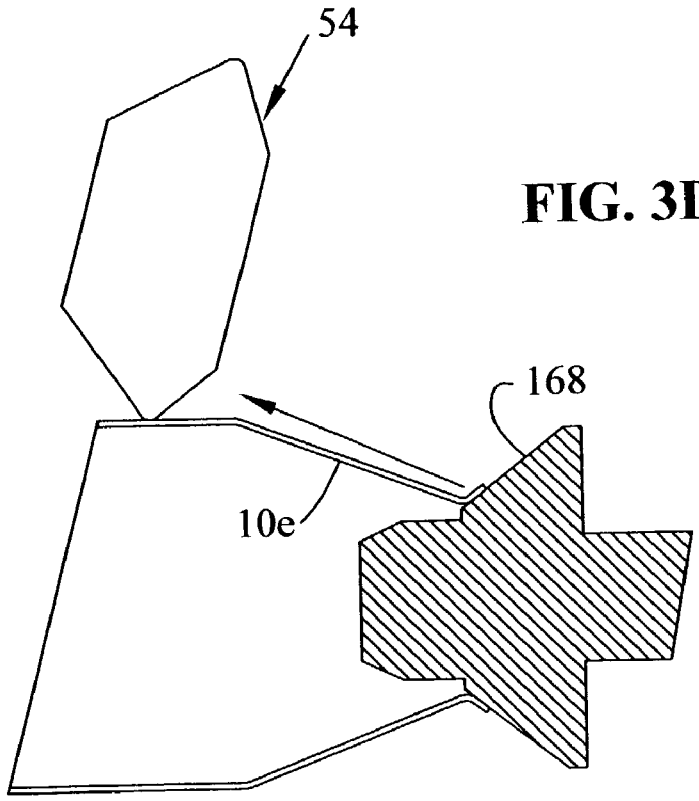
Figure 3E:
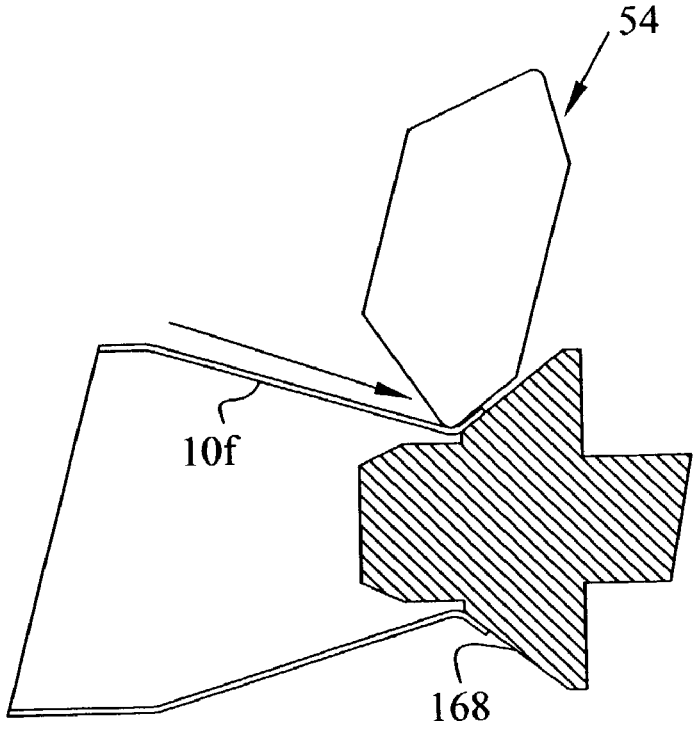
Figure 3F:
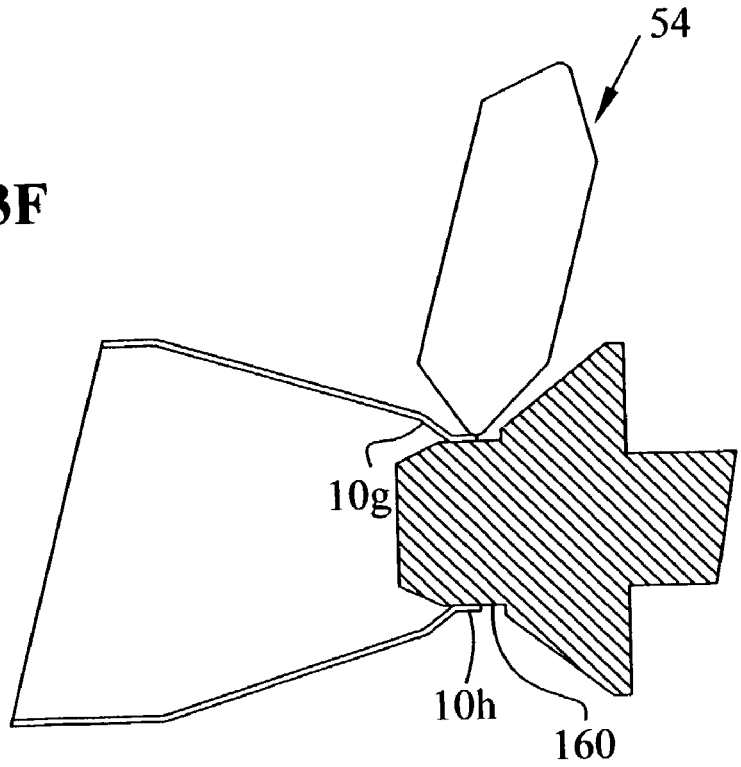
Figure 3G:
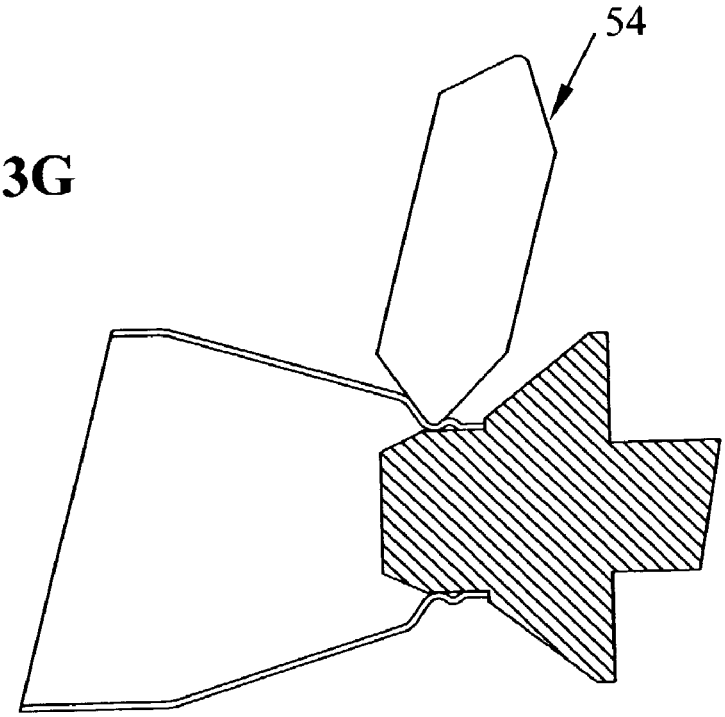
Figure 3H:
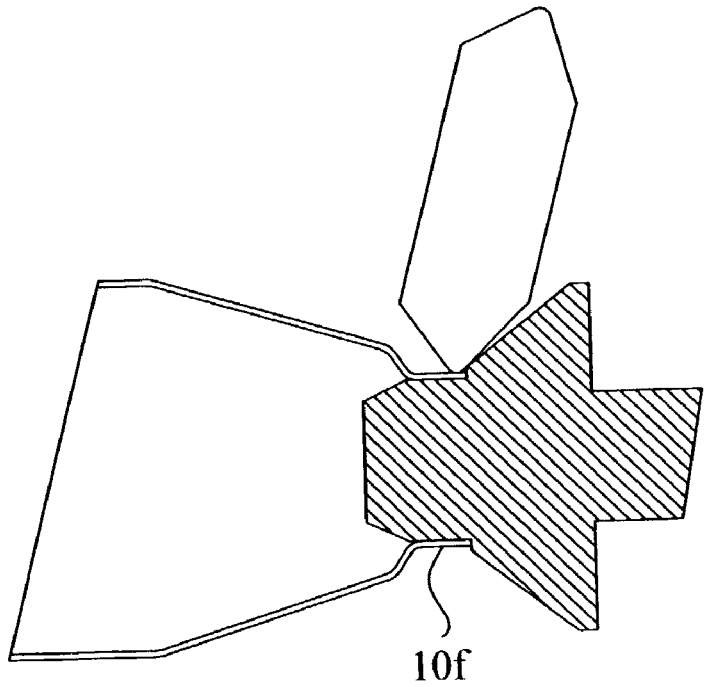
Figure 3I:
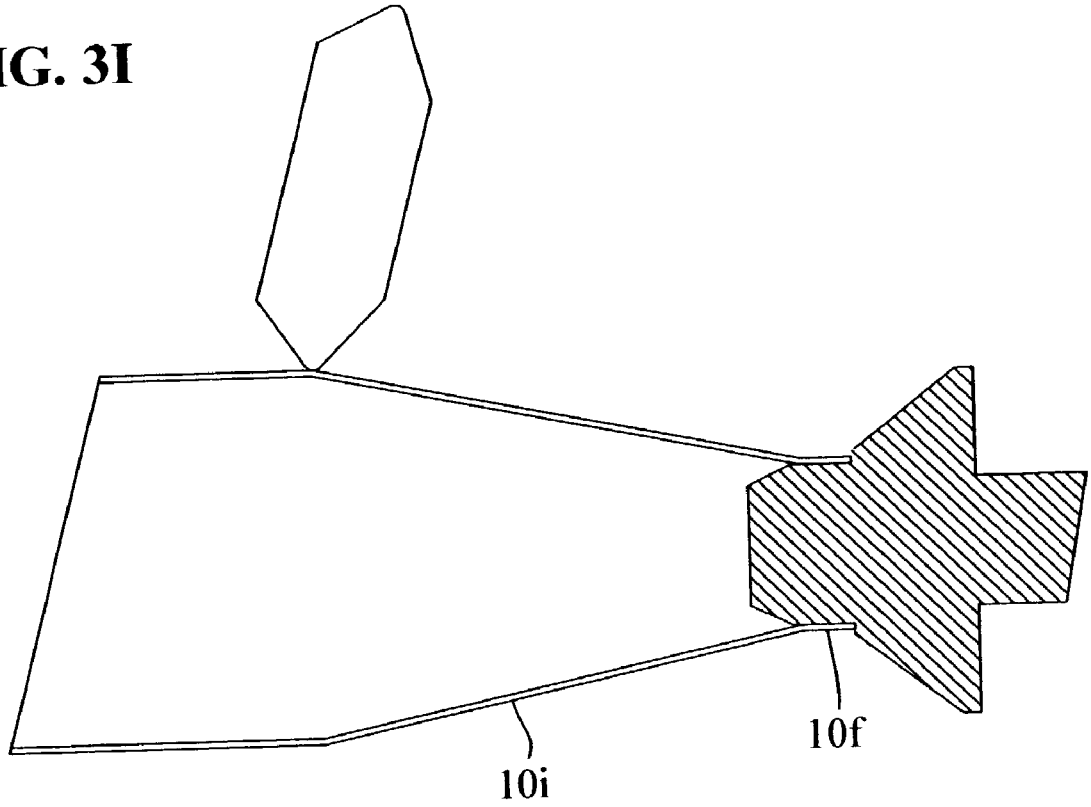

With respect now to FIGS. 3D and 3E, roller 54 now takes deep passes, first from right to left as in FIG. 3D, to define transition section 10*e*, and then from left to right as shown in FIG. 3E, to define a near complete configuration of the transition section as 10*f*. When in the position of FIG. 3E, the mandrel 156 is moved to the right, to the position shown in FIG. 3F, and a transition section 10*g* is formed, together with land 10*h*, which lies adjacent to mandrel portion 160. When in this position, the roller can thereafter move in the opposite direction, that is, from left to right as viewed in FIG. 3G and flow form the material of land 10*h* into shoulder 164, as shown in FIG. 3H. Any further transitional changes can also be formed, such as the process step according to FIG. 3I forming transition section 10*i*. Advantageously, the process according to FIGS. 3A–3I causes less distortion of the end edges, due to the movement of the roller 54 from right to left in the process step according to FIG. 3B and therefore reduces the overall process time of the production of the tubular member from the configuration of FIG. 3A to the configuration of FIG. 3C.

Figure 4B:
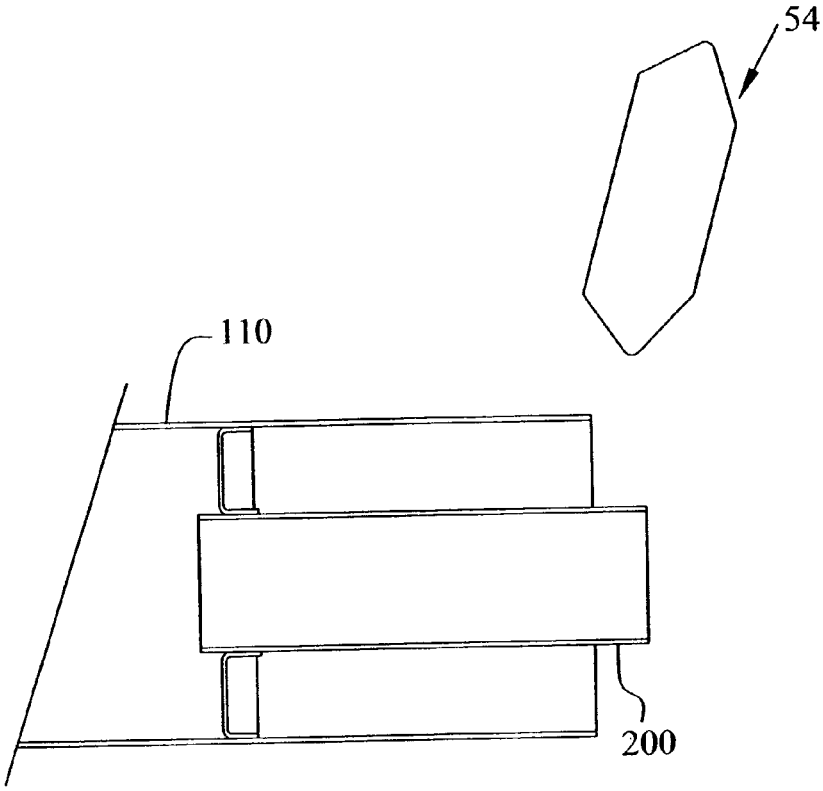
Figure 4B:
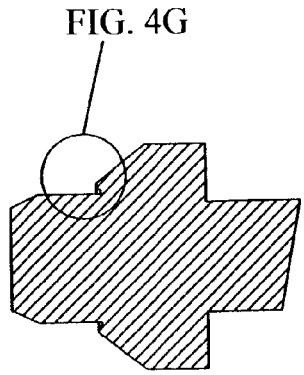
Figure 4C:
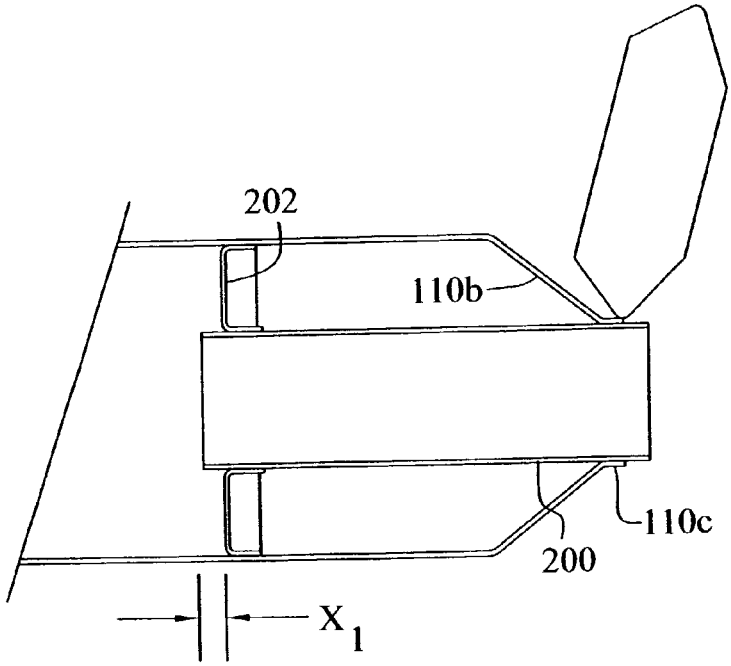
Figure 4C:
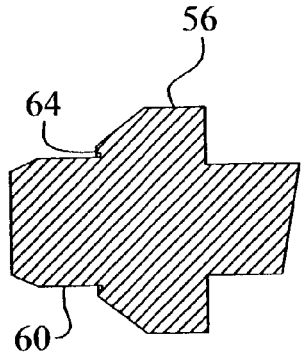
Figure 4D:
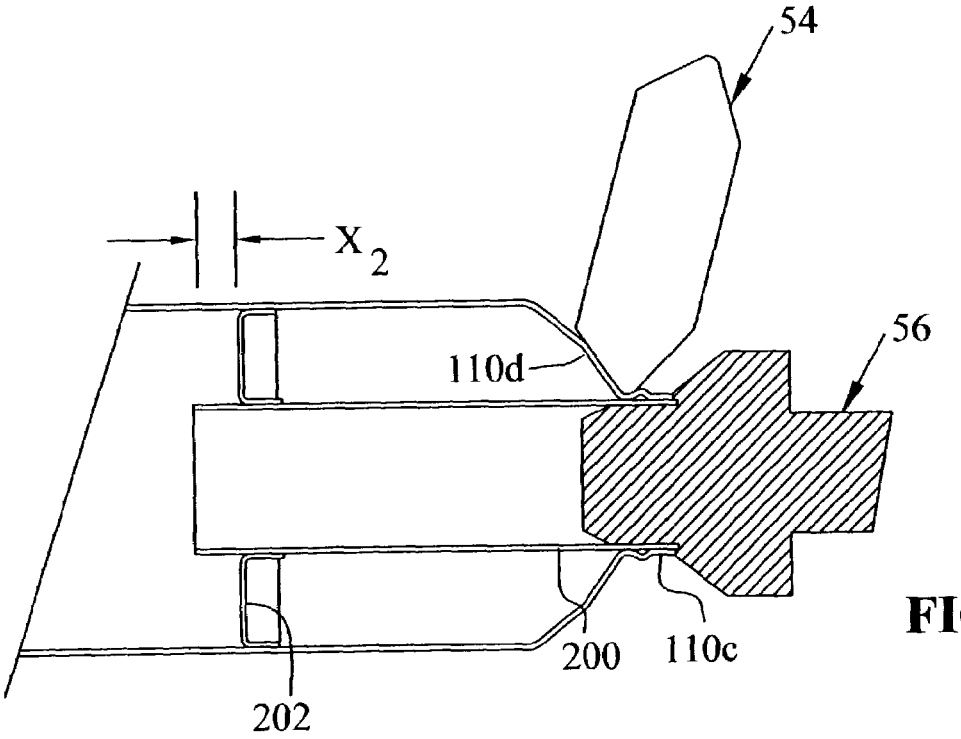
Figure 4E:
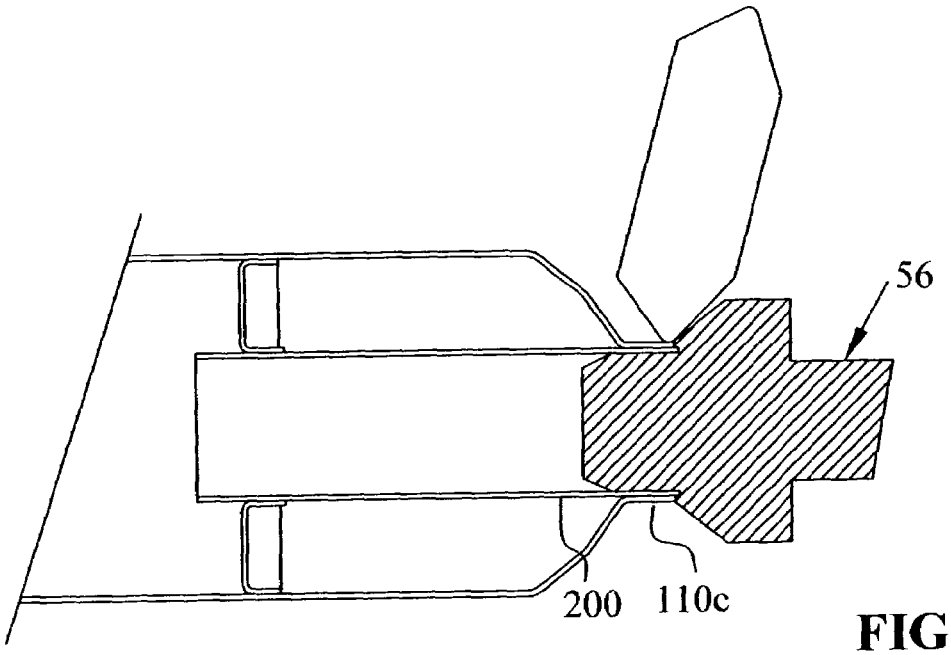

With reference now to FIG. 4A, another tubular member can be assembled, whereby an inner tubular member 200 can be positioned co-axially to tubular member 110 and held in place at one end by a baffle plate, such as 202. As shown in FIGS. 4B and 4C, roller 54 can be moved inwardly and transversely of the tube 110, to form the end of tubular member 110 into a reduced diameter section 10*b*, and having a land section 110*c*, which conforms to the diameter of inner tubular member 200. As shown best in FIG. 4G, the front shoulder 64 is undercut at 66, as will be described herein. When the tube 110 and inner tube 200 are in the position shown in FIG. 4C, mandrel 56 can be moved to the left as shown in FIG. 4D, such that the first end portion 60 of mandrel 56 is positioned within the inner tubular member 200, with the inner tubular member 200 fitting within undercut section 66. The mandrel can also help define in this embodiment, the longitudinal position of the inner tube 200. The tube 200 is positioned within the baffle 202 in an interference fit. The end of the mandrel 60 is also insertable into the end of the tube 200 in an interference fit; but the force to insert the mandrel 56 into the inner tube 200 is less than the force to move the inner tube longitudinally within the baffle 200. The mandrel 56 is also designed to provide enough force to overcome the interference fit between the inner tube and the baffle 202, and thus the mandrel and tail stock are able to longitudinally position the inner tube 200 properly within the baffle 202. As shown in FIG. 4C, inner tube 200 extends beyond baffle 202 by a distance $x_1$, whereas when in the position of FIG. 4D, the tube 200 has been pushed through the baffle 202 by the mandrel, so that it now extends through by a length of $x_2$.

Figure 4F:
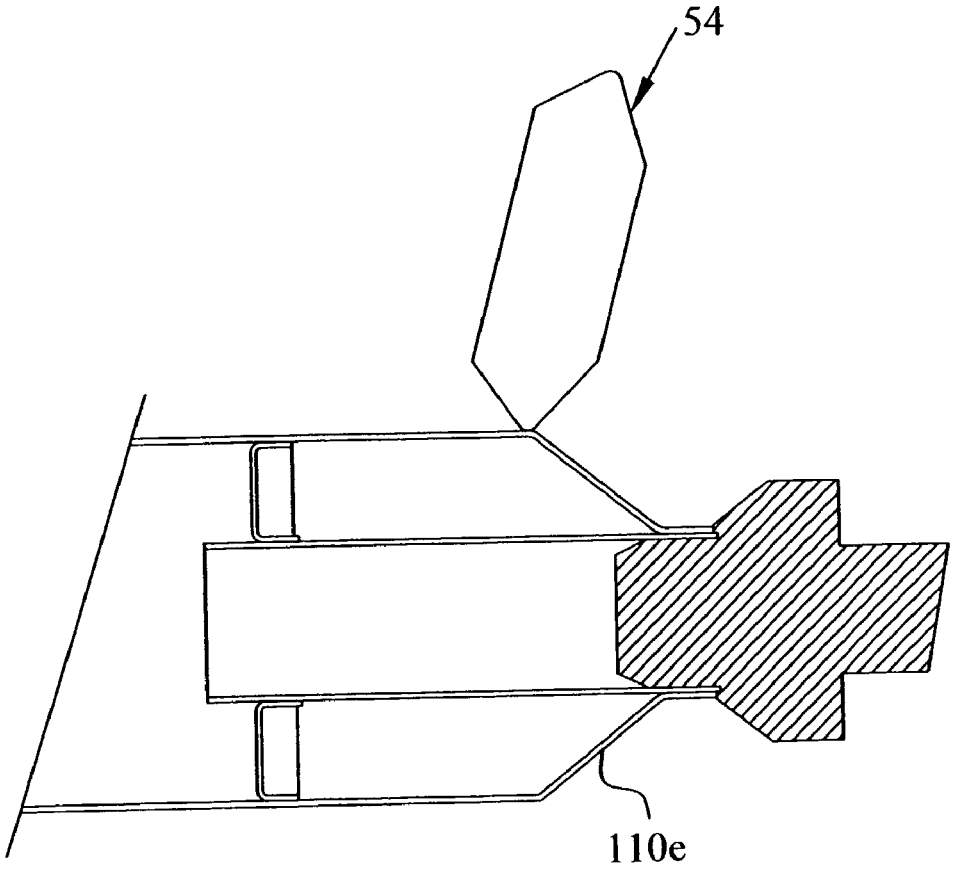
Figure 4G:
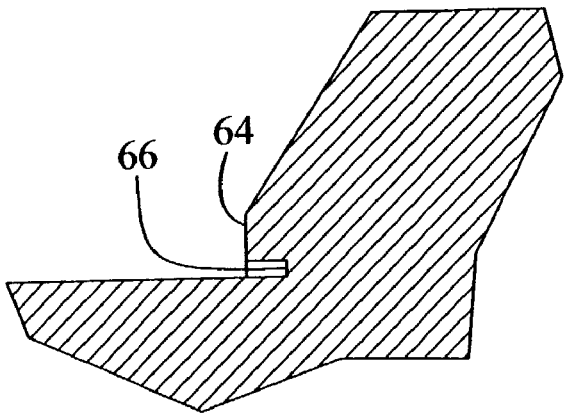

With mandrel 56 as shown in FIG. 4D, the roller 54 is urged into reduced diameter section 110*b* to create transition section 110*d*. The end 110*c* can then be flow formed as described above, from the position shown in FIG. 4D to a position shown in FIG. 4E, such that the end edges of section 110*c* abut shoulder 64. Due to undercut 66, inner tube 66 protrudes somewhat from the end of tube end 110*c*. The tube 110 can thereafter be finished by successive passes of the roller 54 to form the end transition profile 110*e*, as shown in FIG. 4F. Also due to the uneven ends of the inner tube 200 and end 100*c*, the two ends can be easily welded together, to form the finished product.

Figure 5:
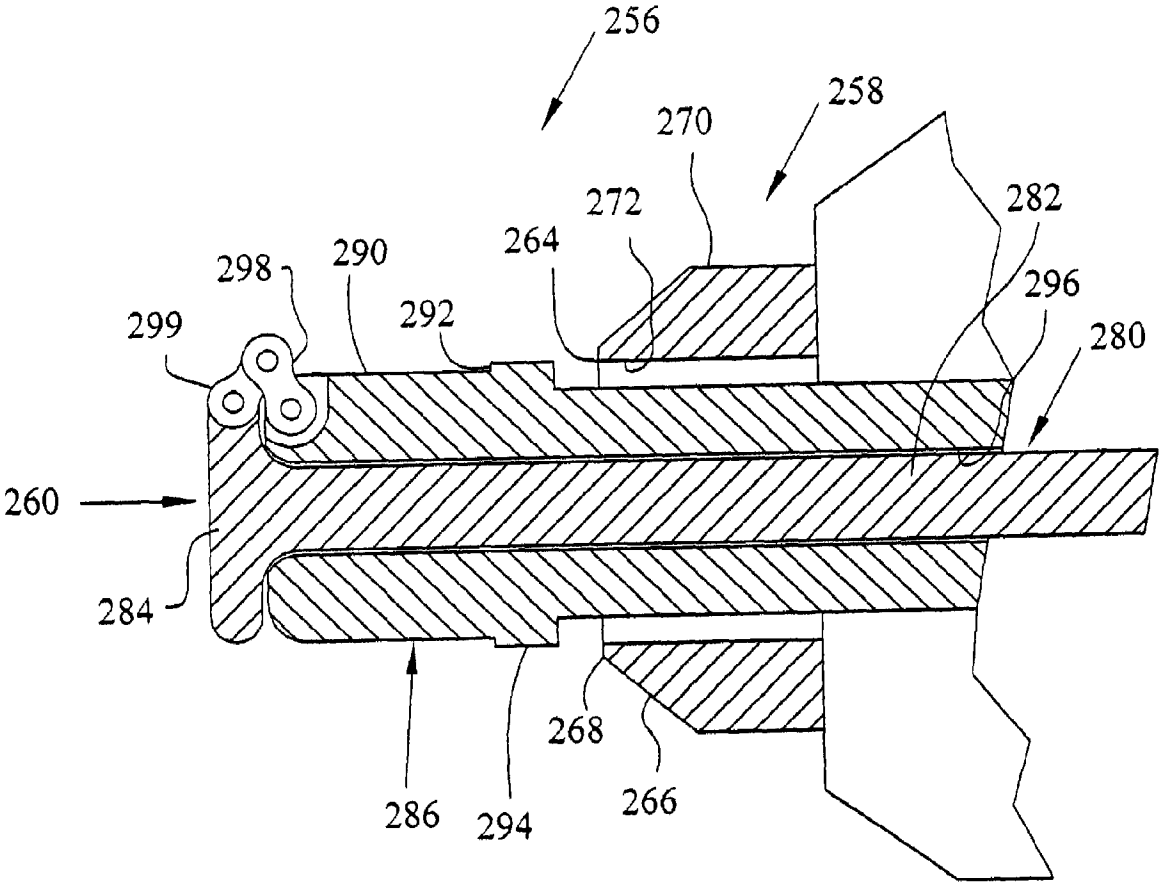
Figure 7:
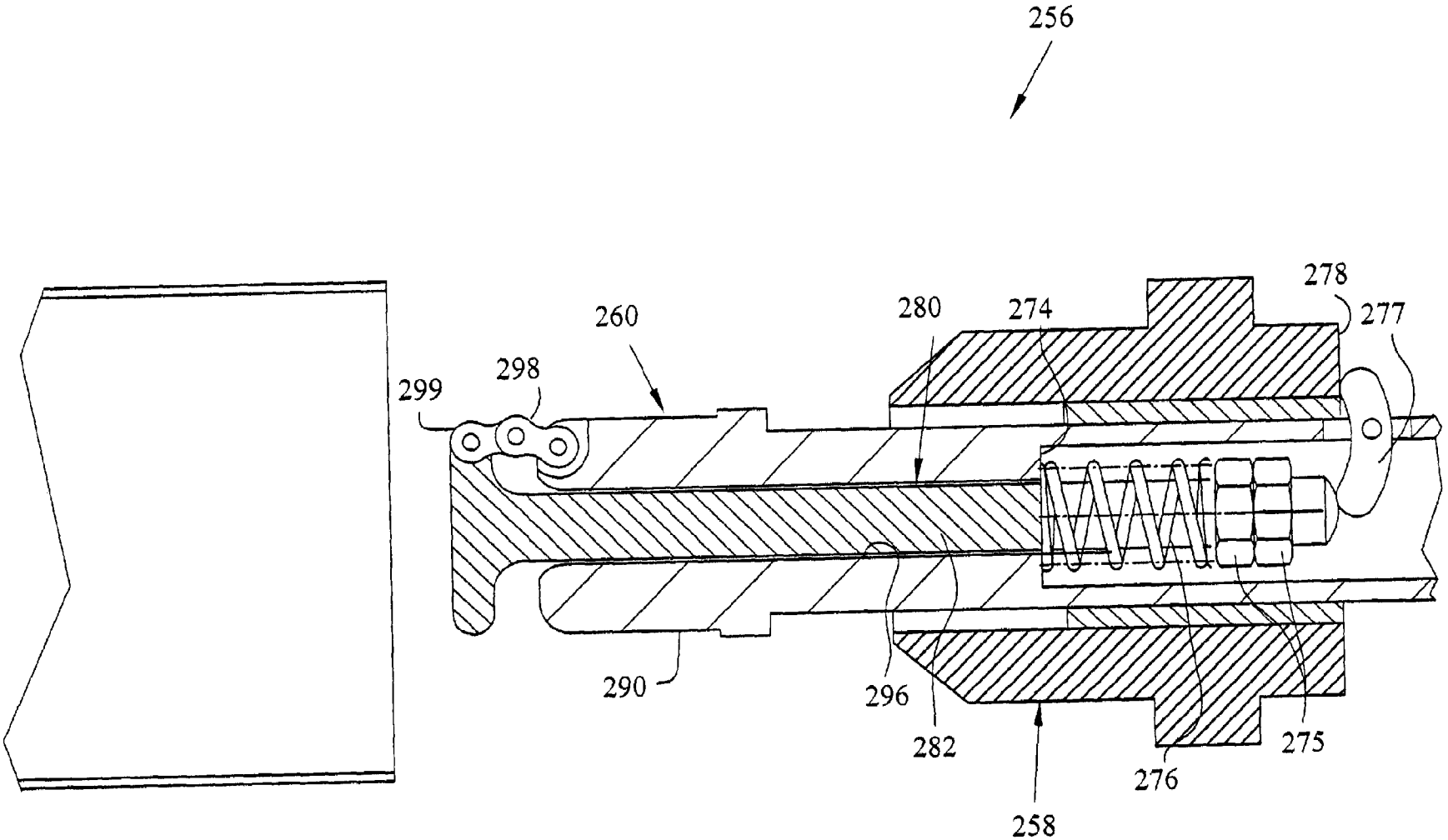

With respect now to FIGS. 5–7, a further mandrel is shown at 256, generally comprised of a frusto-conical section 258 and a mandrel end section 260, where the mandrel end section 260 and frusto-conical section 258 are movable longitudinally relative to each other. Frusto-conical section 258 includes a front end section 264 forming a shoulder, an inclined section 266, which extends from a radial dimension at 268 to a radial dimension at 270. The frusto-conical section 258 further includes an inner bore at 272 for receiving the movable front end portion at 260, as described further herein.

With respect still to FIG. 5, the mandrel end section 260 is comprised of a central movable pin member 280 comprised of a central rod 282 having a front head section 284, and an outer member 286. The outer member 286 includes a first diametrical section at 290 having a shoulder at 292 and a second diametrical portion at 294. The outer member 286 further includes an inner bore at 296 to receive pin section 282 therein. As shown, the pin portion 280 and outer member 286 are linked together by way of toggle links 298 and 299. As shown in FIG. 6, the frusto-conical section 258 and mandrel end section 260 are movable longitudinally to a position where diametrical portion 294 (FIG. 5) is positioned within bore 272. It should be noted that in this position, shoulders 264 and 292 are longitudinally aligned; however, the mandrel can be designed so as to form an undercut section, similar to that described above in relation to undercut 66.

Finally, as shown in FIG. 7, the central pin portion 280 is movable longitudinally to the mandrel end portion 260 to a position where the outer profile of the toggle links are equal to or less than the profile defined by diameter portion 290. Section 286 includes an inner base at 274 forming an inner shoulder. Pin member 282 is also threaded at an end thereof to receive lock nuts 275, trapping a compression spring 276 therebetween. This spring loads the pin member 280 in the normally closed position of FIG. 5. Link 277 is pinned to member 286 and toggles between an end of pin member 282, and an end surface 278 of frusto-conical member. Thus, when frusto-conical member 258 retracts to the position shown in FIG. 7, pin member 282 is pushed outwardly of the member 286, thereby lowering the toggle links 298, 299.

Figure 8A:
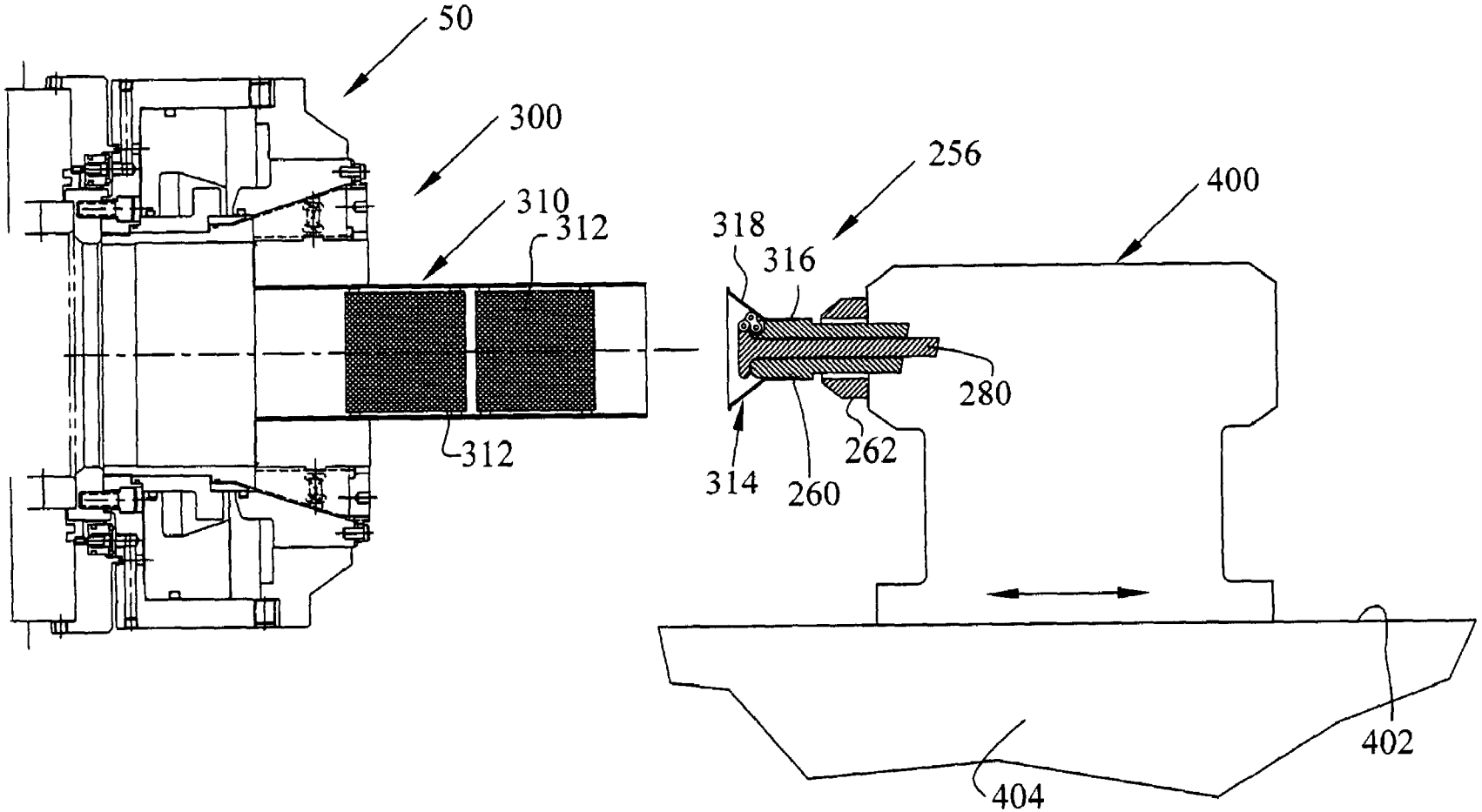
FIGS. 8A–8F show the apparatus and process steps incorporating the mandrel of FIGS. 5–7.
Figure 8B:
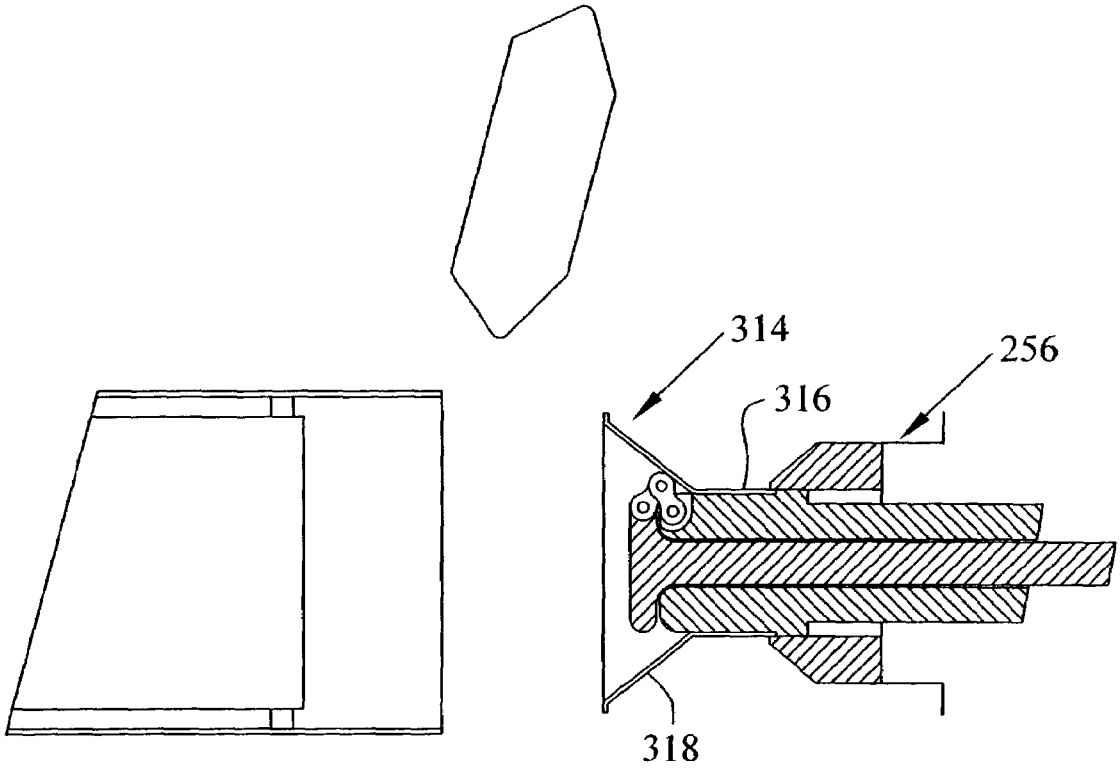

With respect now to FIGS. 8A–8F, a catalytic converter 300 can be assembled with the use of mandrel 256 of FIGS. 5–7, which includes outer tube 310, monolith substrates 312, and heat shields 314. As shown in FIG. 8A, the tube 310 can be held in place by chuck 50, with monoliths 312 positioned within tube 310. As shown best in FIG. 8B, heat shield 314 is held in place on mandrel 256, where annular flange 316 of heat shield 314 is positioned on diameter portion 290 (FIG. 5) and abuts shoulder 292. With the center pin portion 280 retracted, toggle links 298 and 299 retain funnel-shaped section 318, as shown in FIG. 8B. Mandrel 256 is integrated with tail stock member 400 (FIG. 8A), which is movable on a top surface 402 of platen 404.

Figure 8C:
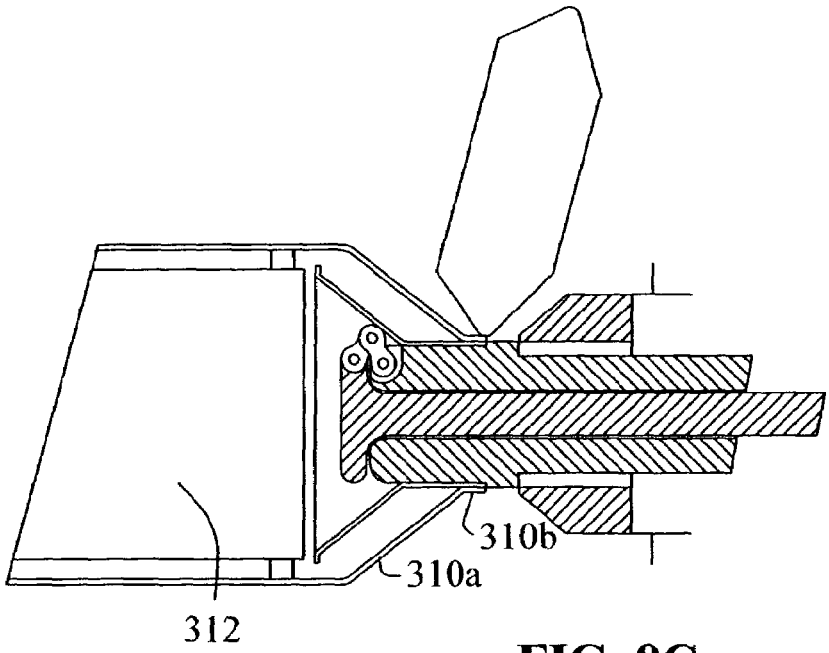
Figure 8D:
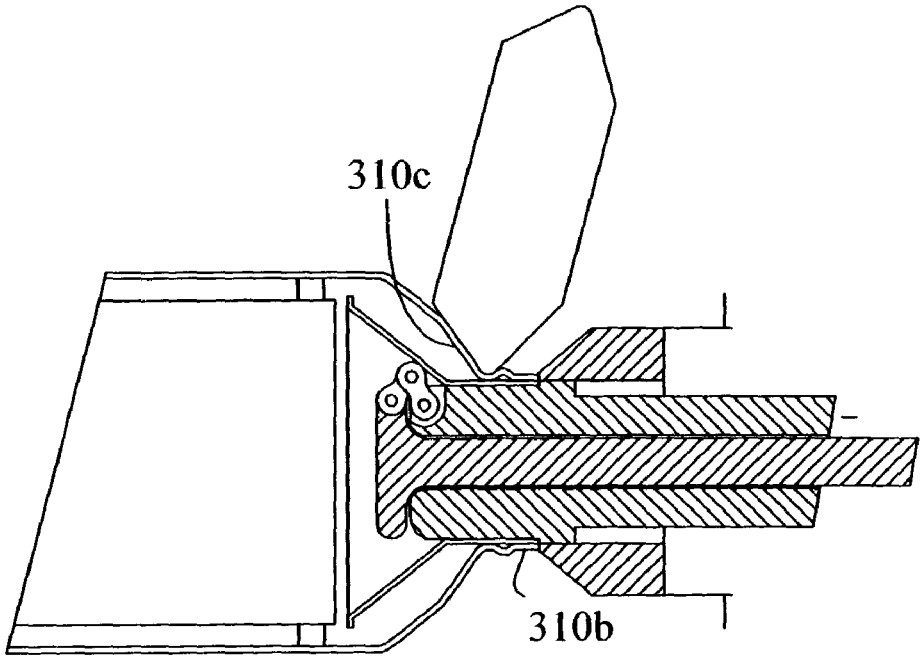
Figure 8E:
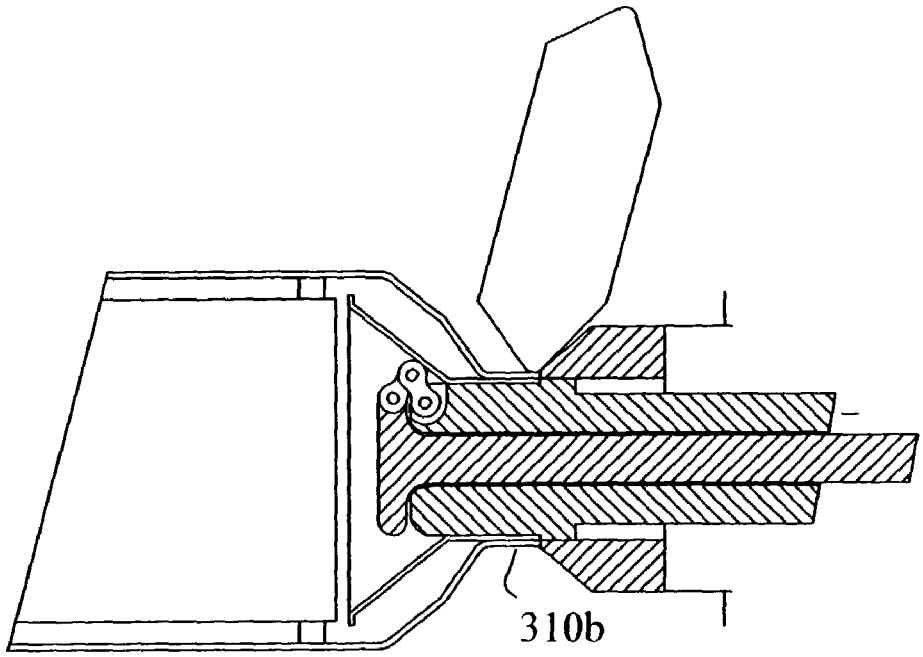
Figure 8F:
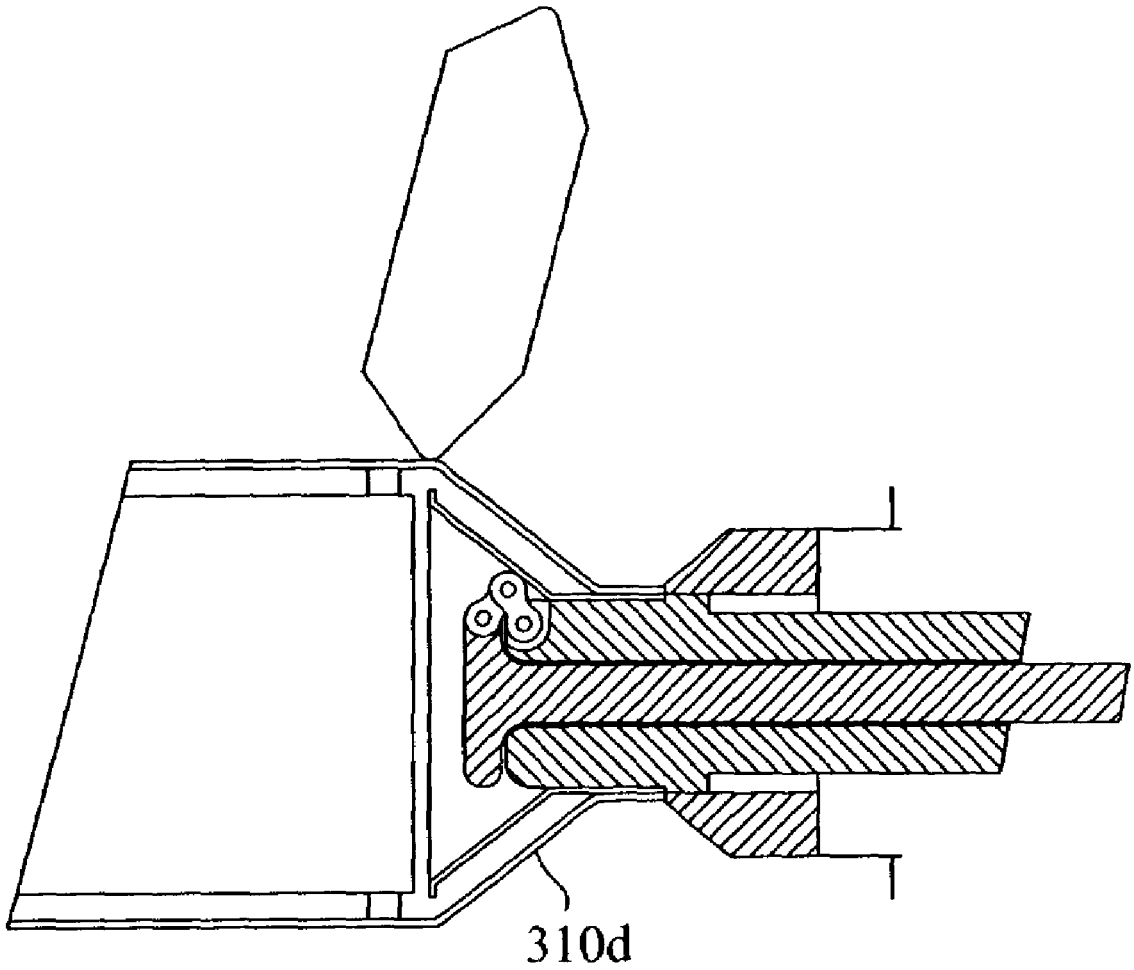
Figure 10:
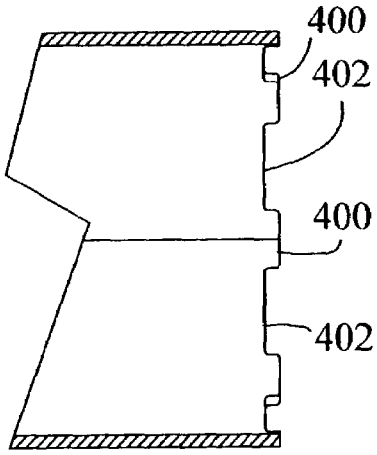
FIGS. 9–20 show various end edges which can be created with the disclosed method and apparatus.
Figure 9:
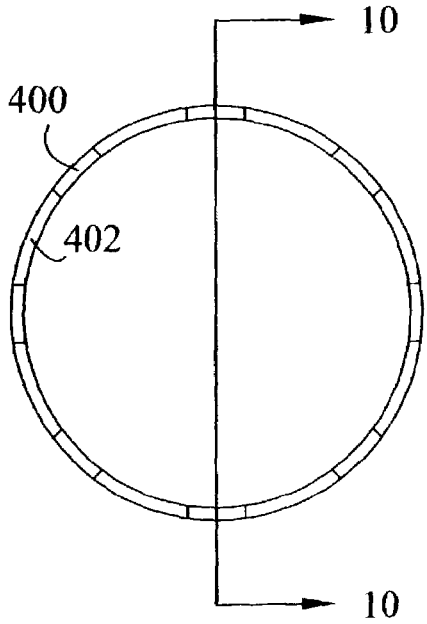

Thus, to position the heat shield 314 within tube member 310, tail stock member 400 is moved to the left, as shown in FIG. 8B, to position the heat shield member 314 against the outer monolith substrate 312, as shown in FIG. 8C. With the heat shield positioned therein as shown, the spinning process can begin to produce a reduced diameter section 310*a* and land 310*b*. The mandrel can now be positioned in the configuration previously described with relation to FIG. 6 to position shoulder 264 co-aligned with the end of heat shield annular flange 316. Roller 54 first forms transition section 310*c*, as shown in FIG. 8D. The flow forming of tubular member 310*b* is now performed, as shown in FIG. 8D, such that the length of the annular portion 310*b* is the identical length as annular flange 316 of heat shield 318 and forms a square abutment therewith. The roller 54 moves, and flow forms the material of section 310*b*, from the position of FIG. 8D to the position of FIG. 8E. The roller is thereafter moved towards the chuck, as shown in FIG. 8F, to form a consistent transition section 310*d*. As mentioned above, the end face 264 can overlap shoulder 292, to create an undercut, similar to 66 described above, such that the finished product has annular flange 316 protruding slightly beyond finished end 310*b*. This allows for easier welding of the two ends.

Figure 12:
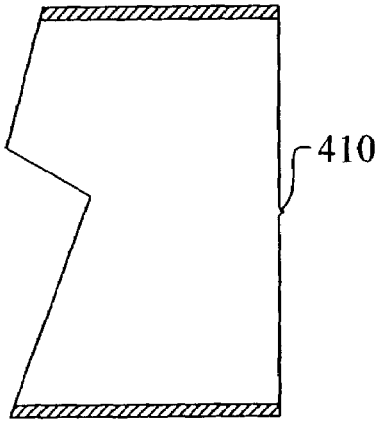
Figure 11:
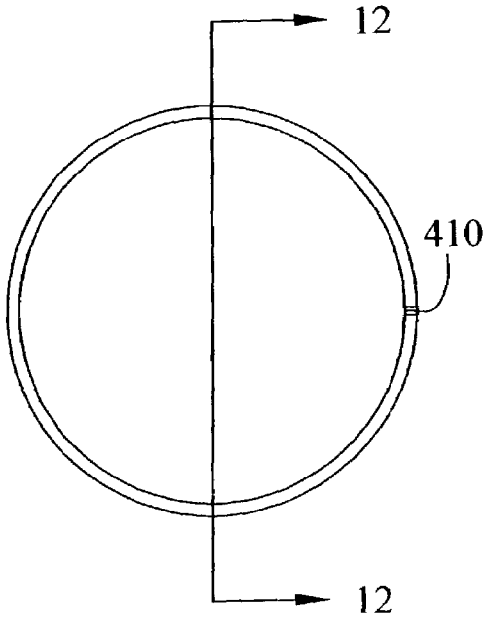
Figure 14:
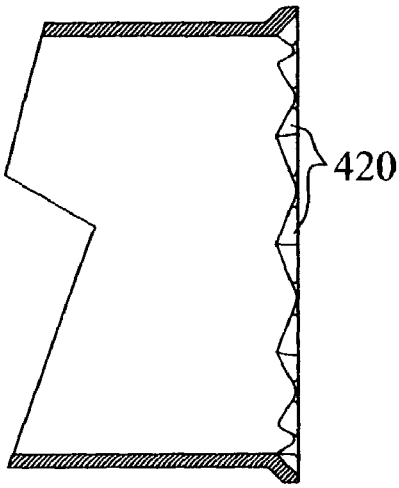
Figure 13:
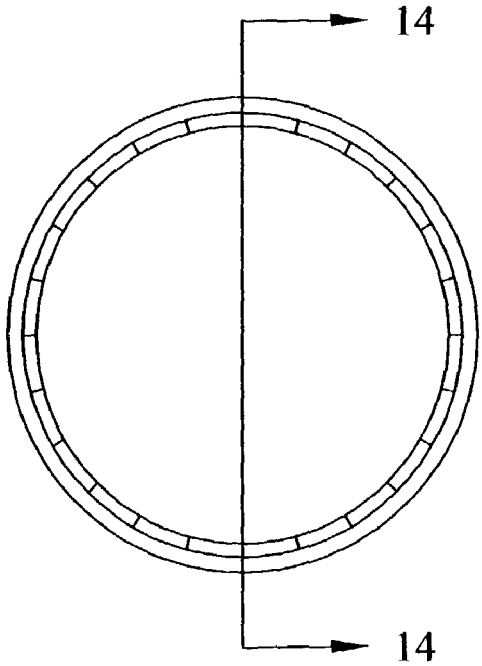
Figure 16:
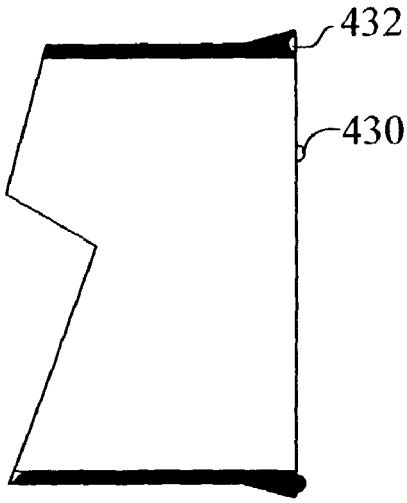
Figure 15:
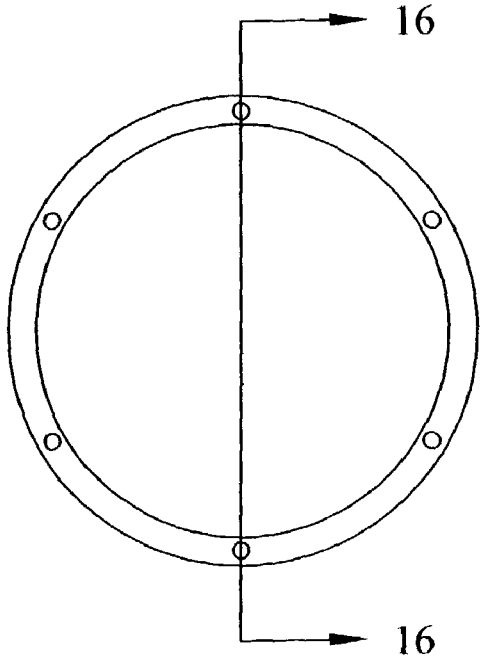
Figure 18:
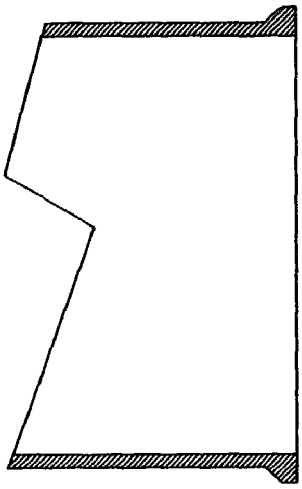
Figure 17:
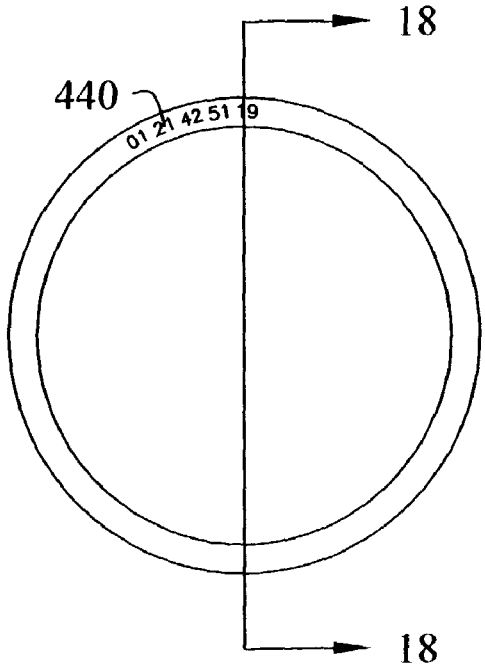

With respect now to FIGS. 9–20, various end edges can be created by the disclosed method and apparatus, whereby any of the shoulders 20, 64, 164 or 264 can include the configuration to define the end edges. With respect first to FIGS. 9 and 10, one of the shoulders could include a profile to define interdigitated raised portions, such as 400, such that the shoulder portions would include counterpart portions to define the recessed edges, for example at 402. Similarly, the mandrel shoulders could include a recessed notch so as to define a nib, such as 410, as shown in FIGS. 11 and 12. As shown in FIGS. 13 and 14, the mandrel shoulders could include a profile so as to define castellated portions 420. Also with respect to FIGS. 15 and 16, the mandrel shoulders could include recesses and dimples so as to define counterpart dimples 430 and recesses 432. As shown in FIGS. 17 and 18, the shoulder could also include raised text 440 so as to define text 440 recessed into the end face of the finished work product.

Figure 20:
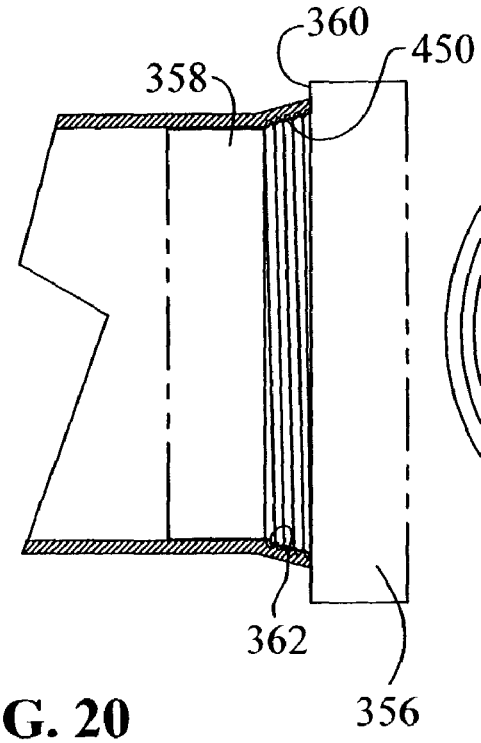
Figure 19:
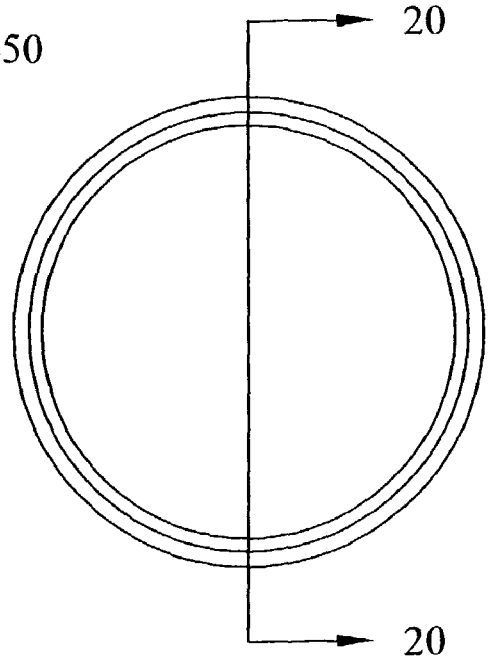

With respect now to FIGS. 19 and 20, an alternate mandrel 356 is shown having a forward end section 358 and a forwardly facing shoulder 360. Intermediate the sections 358 and 360 are defined counterpart threaded sections 362 so as to define threaded section 450.

As should be appreciated, once the spinning process is complete, to the configuration of FIG. 8F, the central pin portion 280 of the mandrel is moved to the configuration of FIG. 7, such that the toggle links collapse and the entire mandrel portion, including the outer portion 260 and the central pin portion 280, can be retracted by way of reversing the tail stock 400, which slides the entire mandrel out of the completed end. The partially completed catalytic converter 310 can now be reversed, with the completed end positioned within the chucks, and another heat shield can be positioned in the unfinished end of the catalytic converter 310, as just described.

What is claimed is:

1. A method of spinning a material to a circumferential configuration having a constant length, the method comprising the steps of:

providing the material to be spun;

holding the material;

spinning the material about a longitudinal axis;

moving a tooling roller tangentially towards said spinning material, and moving said roller along an axis parallel to said longitudinal axis, thereby spinning said material to a radially different configuration;

providing a shoulder with a predefined definition, and flow forming said material towards and into said shoulder such that free end edges of said material abut said shoulder to conform said end edges to said predefined definition.

2. The method of claim 1, wherein said shoulder is provided as a transverse plane, transverse to said longitudinal axis.

3. The method of claim 2, wherein said shoulder is provided in the form of a mandrel.

4. The method of claim 3, wherein said mandrel is provided in a dimension generally along said longitudinal axis, having a first end portion with a constant first end diameter to extend below said free end edges, and a second diameter, spaced from said first end diameter, and having a diameter larger than said first end diameter forming said shoulder therebetween.

5. The method of claim 4, wherein said material is provided tubular in shape.

6. The method of claim 5, wherein said material is held by a chuck, and said chuck spins about said longitudinal axis to spin said tubular material.

7. The method of claim 6, wherein said tooling roller is moved in a direction from said chuck towards said mandrel.

8. The method of claim 6, wherein said free end edges are spun to a diameter less than said first end diameter, and said first end of said mandrel is forced into said tubular spun end.

9. The method of claim 8, wherein said flow forming step is performed by moving said tooling roller along said material, forcing said material against said first end portion of said mandrel, thereby moving said material towards said shoulder.

10. The method of claim 6, further comprising the step of providing an inner member, profiled for receipt within said tubular member, wherein said tubular member is spun to encapsulate said inner member.

11. The method of claim 10, wherein a catalytic converter is formed by the further steps of:

inserting at least one monolith substrate into said tubular member, prior to said spinning process, and spacing said monolith from an end to be spun;

positioning a funnel shaped heat shield into said tubular member, with a reduced diameter section directed outwardly, and with an enlarged diameter section adjacent to said substrate; and spinning said tubular end to generally conform to the shape of said funnel shaped heat shield.

12. The method of claim 5, wherein said mandrel is provided with a frusto-conical shaped portion, extending continuously from said first end portion.

13. The method of claim 12, wherein said second diameter is less than a diameter of said tubular member, and said frusto-conical shaped portion has an end diameter larger than a diameter of said tubular member.

14. The method of claim 13, wherein said mandrel, prior to said spinning step, is positioned with said frusto-conical shaped portion in abutment with said tubular member, and said tubular member is spun by moving said tooling roller in a direction from said mandrel towards said chuck, thereby collapsing said tubular member against said frusto-conical shaped member.

15. The method of claim 14, further comprising the steps of gradually backing the mandrel out, and continuously spinning the material to a further reduced diameter portion.

16. A spinning apparatus for spinning a material workpiece to a circumferential configuration having a constant length, the spinning apparatus comprising:

a spinning chuck having jaws to hold a material workpiece to be spun;

a mandrel having a first end having a constant diameter, which terminates into a shoulder, the mandrel being longitudinally movable into an open end of the workpiece; and a spinning roller that flow forms an end of the material workpiece into said shoulder so that an edge of the material workpiece contacts said shoulder.

17. The spinning apparatus of claim 16, wherein said mandrel further comprises a frusto-conical portion extending from said mandrel first end, said frusto-conical portion enlarging away from said mandrel first end, whereby an end of said frusto-conical portion forms said shoulder.

18. The spinning apparatus of claim 17, wherein said frusto-conical portion is longitudinally movable relative to said mandrel first end.

19. The spinning apparatus of claim 18, wherein said mandrel first end has a holding mechanism for holding an item to be inserted into said material workpiece.

20. The spinning apparatus of claim 19, wherein said holding mechanism is comprised of telescopically movable members, connected at their front ends by way of a toggle link, whereby the members have a first position wherein the toggle links form the holding member and have a radial dimension greater than the mandrel first end, and a second position whereby the toggle links have a radial dimension equal to or less than the mandrel first end.

* * * * *